US011615915B2

(12) United States Patent
Jergovic et al.

(10) Patent No.: US 11,615,915 B2
(45) Date of Patent: Mar. 28, 2023

(54) LOW-HEIGHT COUPLED INDUCTORS

(71) Applicant: Maxim Integrated Products, Inc., San Jose, CA (US)

(72) Inventors: Ilija Jergovic, Palo Alto, CA (US); Alexandr Ikriannikov, Castro Valley, CA (US); Di Yao, San Jose, CA (US)

(73) Assignee: Maxim Integrated Products, Inc., San Jose, CA (US)

( * ) Notice: Subject to any disclaimer, the term of this patent is extended or adjusted under 35 U.S.C. 154(b) by 675 days.

(21) Appl. No.: 16/593,108

(22) Filed: Oct. 4, 2019

(65) Prior Publication Data

US 2020/0111604 A1 Apr. 9, 2020

Related U.S. Application Data

(60) Provisional application No. 62/741,144, filed on Oct. 4, 2018.

(51) Int. Cl.

| | |
|---|---|
| ***H01F 27/24*** | (2006.01) |
| ***H01F 27/34*** | (2006.01) |
| ***H01F 27/29*** | (2006.01) |

(52) U.S. Cl.

CPC ..... *H01F 27/346* (2013.01); *H01F 27/24* (2013.01); *H01F 27/29* (2013.01)

(58) Field of Classification Search

CPC ..... H01F 27/346; H01F 27/24; H01F 27/29; H01F 27/2852; H01F 27/38; H01F 37/00; H01F 27/292

See application file for complete search history.

(56) References Cited

U.S. PATENT DOCUMENTS

| | | | | |
|---|---|---|---|---|
| 7,821,375 | B2 * | 10/2010 | Dong | H01F 37/00 336/200 |
| 8,779,885 | B2 | 7/2014 | Li et al. | |
| 8,975,995 | B1 * | 3/2015 | Ikriannikov | H01F 3/10 336/200 |
| 9,767,947 | B1 | 9/2017 | Ikriannikov | |
| 2004/0160298 | A1 | 8/2004 | Hsu et al. | |

(Continued)

OTHER PUBLICATIONS

Dong et al. (2008) "The short winding path coupled inductor voltage regulators," Applied Power Electronics Conference and Exposition, Apec 2008, Twenty-Third Annual IEEE, IEEE, Piscataway, NJ, USA, pp. 1446-1452.

(Continued)

*Primary Examiner* — Mang Tin Bik Lian
(74) *Attorney, Agent, or Firm* — Cozen O'Connor, P.C.

(57) ABSTRACT

A coupled inductor includes a ladder magnetic core including (a) a first rail and a second rail separated from each other in a first direction and (b) a plurality of rungs separated from each other in a second direction. The second direction is orthogonal to the first direction, and each rung of the plurality of rungs is disposed between the first rail and the second rail in the first direction. The coupled inductor further includes a plurality of windings, where each winding of the plurality of windings is partially wound around a respective one of the plurality of rungs such that each winding of the plurality of windings does not overlap with itself when the coupled inductor is viewed cross-sectionally in a third direction. The third direction is orthogonal to each of the first direction and the second direction.

18 Claims, 22 Drawing Sheets

(56) References Cited

U.S. PATENT DOCUMENTS

| | | | | |
|---|---|---|---|---|
| 2007/0175701 | A1* | 8/2007 | Xu | H01F 37/00 182/111 |
| 2008/0067990 | A1 | 3/2008 | Wei | |
| 2011/0035607 | A1* | 2/2011 | Ikriannikov | H01F 37/00 336/155 |
| 2011/0279212 | A1* | 11/2011 | Ikriannikov | H01F 27/006 336/199 |
| 2012/0300500 | A1* | 11/2012 | Ikriannikov | H01F 30/06 336/170 |
| 2013/0127434 | A1* | 5/2013 | Ikriannikov | H01F 19/04 323/283 |
| 2014/0145688 | A1* | 5/2014 | Ikriannikov | H01F 27/2852 323/234 |
| 2014/0266086 | A1* | 9/2014 | Ikriannikov | H01F 30/12 336/5 |
| 2017/0047155 | A1* | 2/2017 | Yao | H01F 17/04 |
| 2018/0102210 | A1 | 4/2018 | Knoll et al. | |

OTHER PUBLICATIONS

PCT/US2019/054665 International Search Report and Written Opinion dated Jan. 27, 2020, 19 pp.

* cited by examiner

LOW-HEIGHT COUPLED INDUCTORS

RELATED APPLICATIONS

This Applicant claims benefit of priority to U.S. Provisional Patent Application Ser. No. 62/741,144, filed on Oct. 4, 2018, which is incorporated herein by reference.

BACKGROUND

It is known to electrically couple multiple switching sub-converters in parallel to increase switching power converter capacity and/or to improve switching power converter performance. One type of switching power converter with multiple switching sub-converters is a "multi-phase" switching power converter, where the sub-converters, which are often referred to as "phases," switch out-of-phase with respect to each other. Such out-of-phase switching results in ripple current cancellation at the converter output filter and allows the multi-phase converter to have a better transient response than an otherwise similar single-phase converter.

As taught in U.S. Pat. No. 6,362,986 to Schultz et al., a multi-phase switching power converter's performance can be improved by magnetically coupling the energy storage inductors of two or more phases. Such magnetic coupling results in ripple current cancellation in the inductors and increases ripple switching frequency, thereby improving converter transient response, reducing input and output filtering requirements, and/or improving converter efficiency, relative to an otherwise identical converter without magnetically coupled inductors.

Two or more magnetically coupled inductors are often collectively referred to as a "coupled inductor" and have associated leakage inductance and magnetizing inductance values. Magnetizing inductance is associated with magnetic coupling between windings; thus, the larger the magnetizing inductance, the stronger the magnetic coupling between windings. Leakage inductance, on the other hand, is associated with energy storage. Thus, the larger the leakage inductance, the more energy stored in the inductor. Leakage inductance results from leakage magnetic flux, which is magnetic flux generated by current flowing through one winding of the coupled inductor that is not coupled to the other windings of the inductor.

DETAILED DESCRIPTION OF THE EMBODIMENTS

Figure 1:
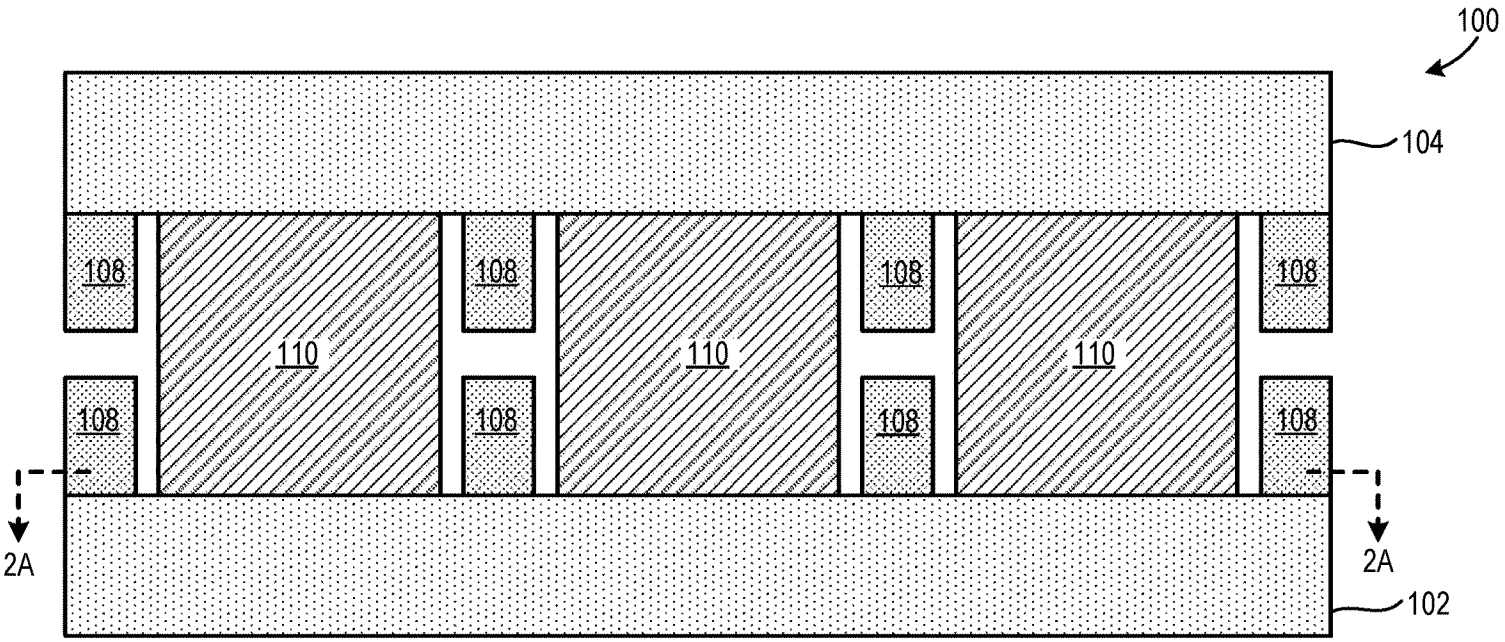
FIG. 1 is a top plan view of a coupled inductor.
Figure 2:
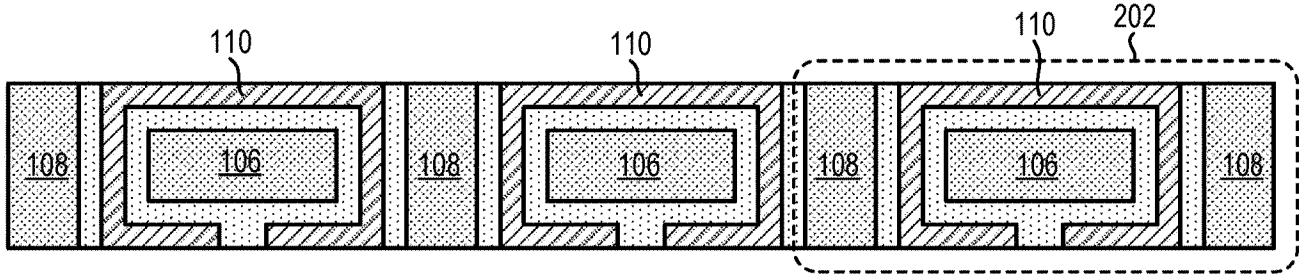
FIG. 2 is a cross-sectional view of the FIG. 1 coupled inductor.
Figure 3:
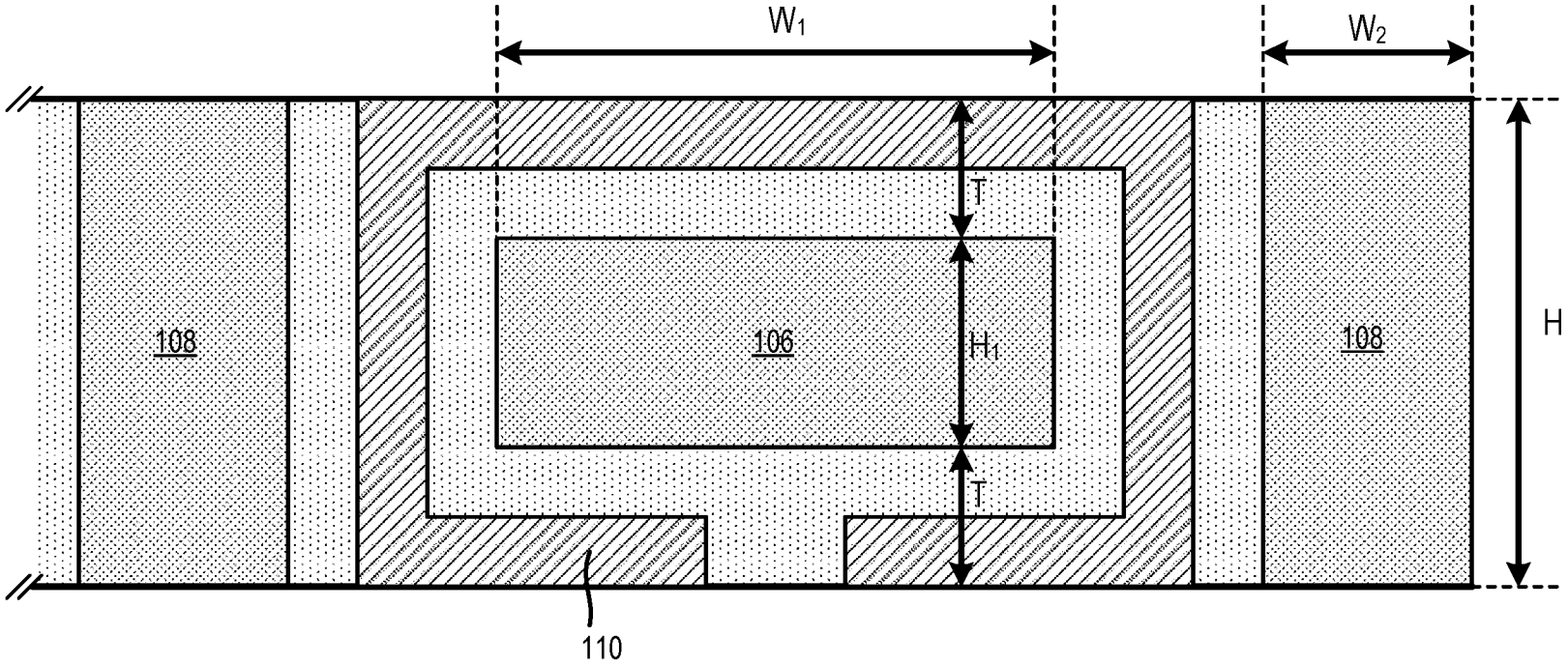
FIG. 3 is a magnified view of a portion of the FIG. 2 cross-sectional view.

FIG. 1 is a top plan view of a coupled inductor 100, FIG. 2 is a cross-sectional view of coupled inductor 100 taken along line 2A-2A of FIG. 1, and FIG. 3 is a magnified view of a portion 202 of the FIG. 2 cross-sectional view. Coupled inductor 100 includes a magnetic core including a first rail 102, a second rail 104, a plurality of rungs 106, and a plurality of leakage teeth 108. A respective winding 110 is wound around each rung 106. As illustrated in FIG. 3, each rung 106 has a width $W_1$, each leakage tooth 108 has a width $W_2$, coupled inductor 100 has a height H, and each rung 106 has a height $H_1$. A portion T of coupled inductor height H is required for each winding 110 layer, to provide space for the winding 110 layer, to allow for tolerances when assembling coupled inductor 100, and to minimize mechanical stress on rungs 106. Rung height $H_1$ is mathematically specified by EQN. 1 as follows:

$$H_1=H-2*T \quad \text{(EQN. 1)}$$

Some applications require that coupled inductor 100 height H be small. In these applications, the winding 110 layers may consume a significant portion, i.e., 2*T, of coupled inductor 100 height H, causing rung height $H_1$ to be very small. Rungs 106 must have a sufficiently large cross-sectional area to prevent magnetic saturation and to prevent excessive core losses. Therefore, rung width $W_1$ must be relatively large when coupled inductor 100 height H is small so that rung cross-sectional area is sufficiently large. As a result, rung aspect ratio $AR_1$, i.e., the ratio of rung width $W_1$ to rung height $H_1$ ($W_1/H_1$), is relatively large in low-height embodiments of coupled inductor 100. Additionally, leakage teeth 108 have an aspect ratio $AR_2$, i.e., the ratio of coupled inductor height H to leakage tooth width $W_2$ ($H/W_2$), which is also relatively large.

The relatively large aspects ratios $AR_1$ and $AR_2$ can be problematic. For example, the magnetic core of coupled inductor 100 is typically formed of one or more ferrite magnetic materials to achieve low core-losses and high inductance values with minimal winding turns. Such ferrite materials are fragile and are difficult to manufacture in thin and/or long shapes. Consequently, ferrite magnetic elements should have a sufficiently small aspect ratio to be manufacturable and to achieve acceptable strength. However, rungs 106 and leakage teeth 108 have relatively large respective aspect ratios $AR_1$ and $AR_2$, as discussed above. Therefore, the magnetic core of coupled inductor 100 is difficult to manufacture and is prone to breaking, when coupled inductor height H is small. Accordingly, coupled inductor 100 is ill-suited for low-height applications.

New low-height coupled inductors at least partially overcome one or more of the problems discussed above with coupled inductor 100. Certain embodiments of the new low-height coupled inductors include windings which form only a single winding layer, as seen when the coupled inductor is viewed cross-sectionally in a vertical or height direction, thereby helping minimize a portion of the coupled inductor's height required for winding layers. As a result, magnetic core elements are able to have relatively small aspect ratios, advantageously promoting manufacturability and durability of the new coupled inductors.

Figure 4:
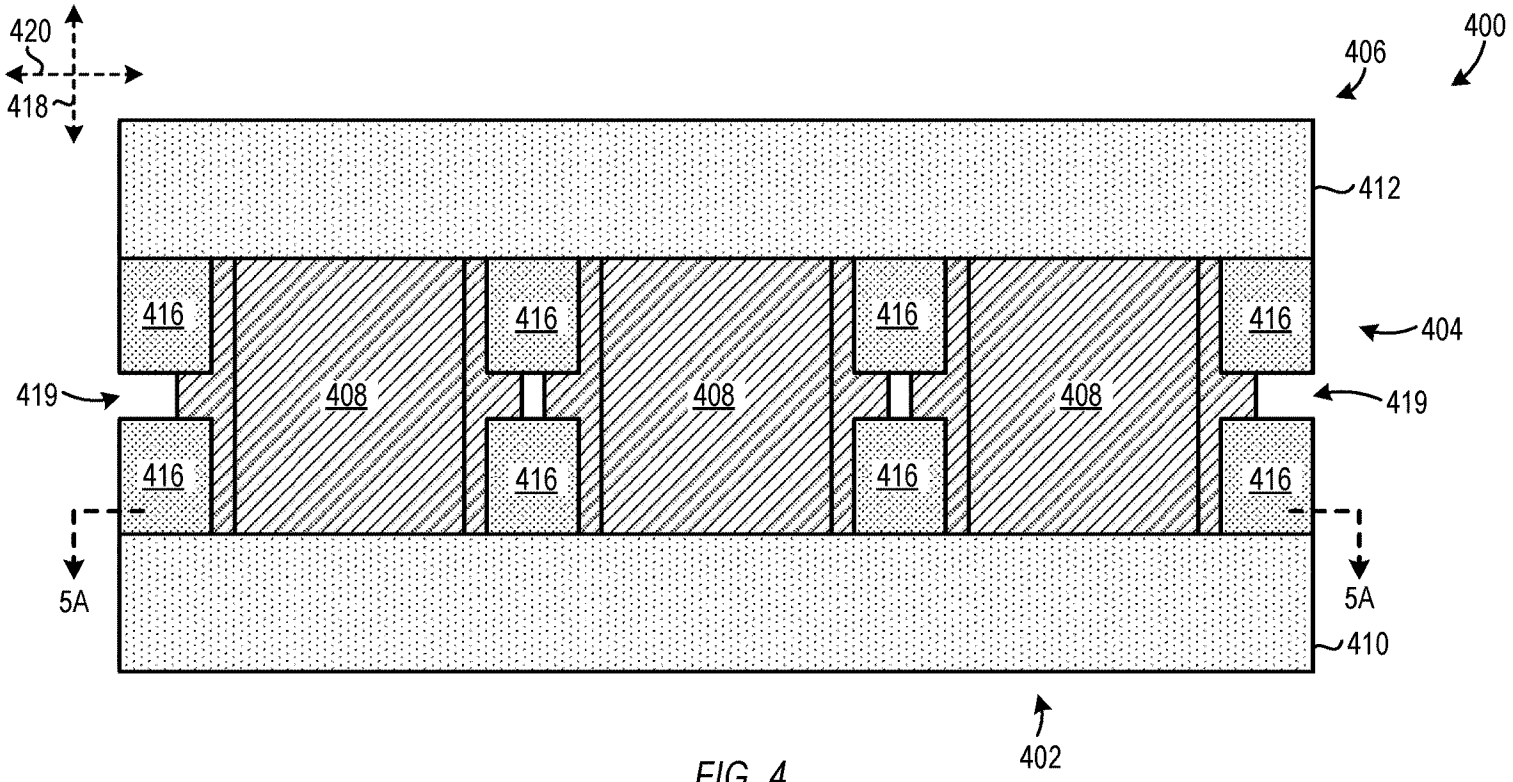
FIG. 4 is a top plan view of a low-height coupled inductor, according to an embodiment.
Figure 5:
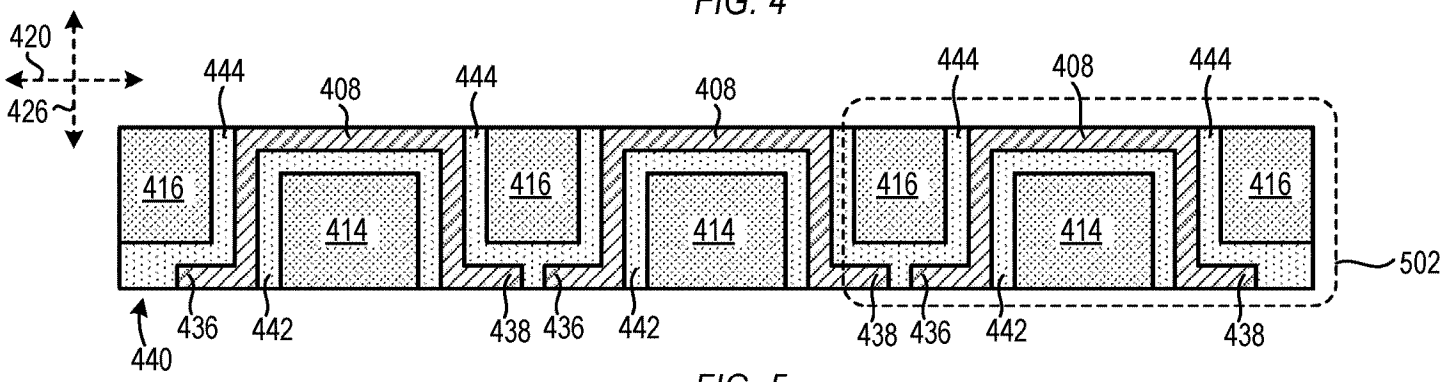
FIG. 5 is a cross-sectional view of the FIG. 4 coupled inductor.
Figure 6:
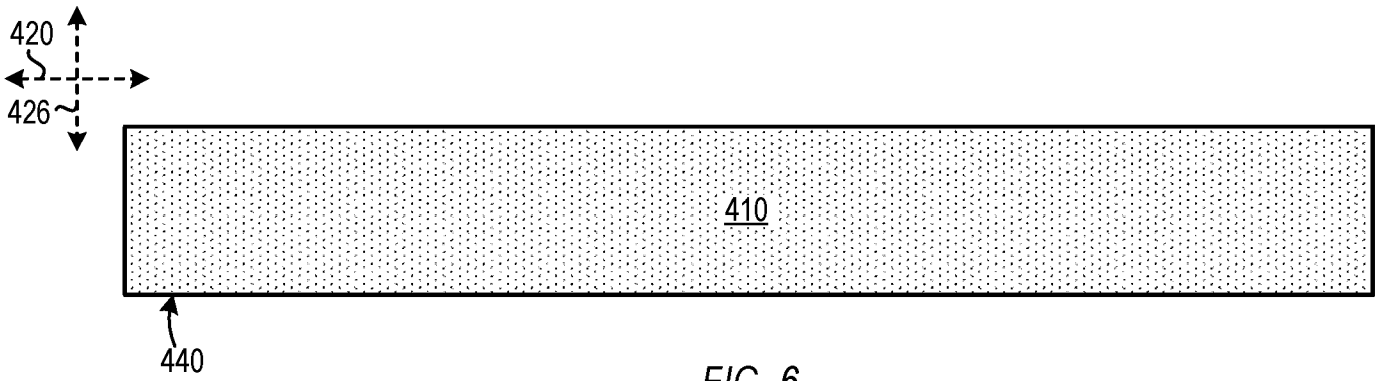
FIG. 6 is a side elevational view of the FIG. 4 coupled inductor.
Figure 7:
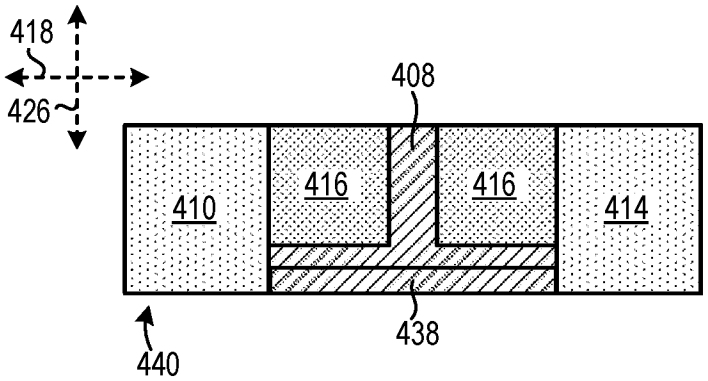
FIG. 7 is another side elevational view of the FIG. 4 coupled inductor.
Figure 8:
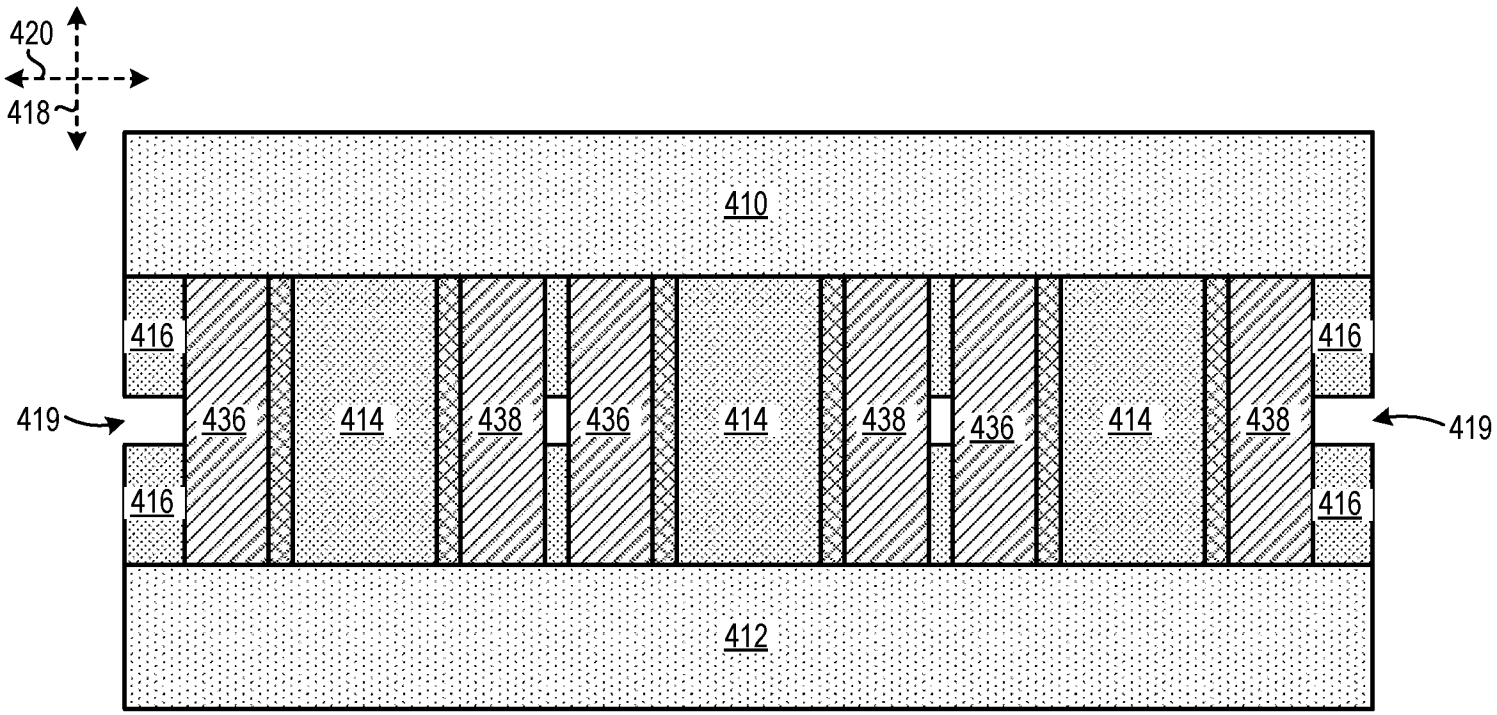
FIG. 8 is a bottom plan view of the FIG. 4 coupled inductor.
Figure 9:
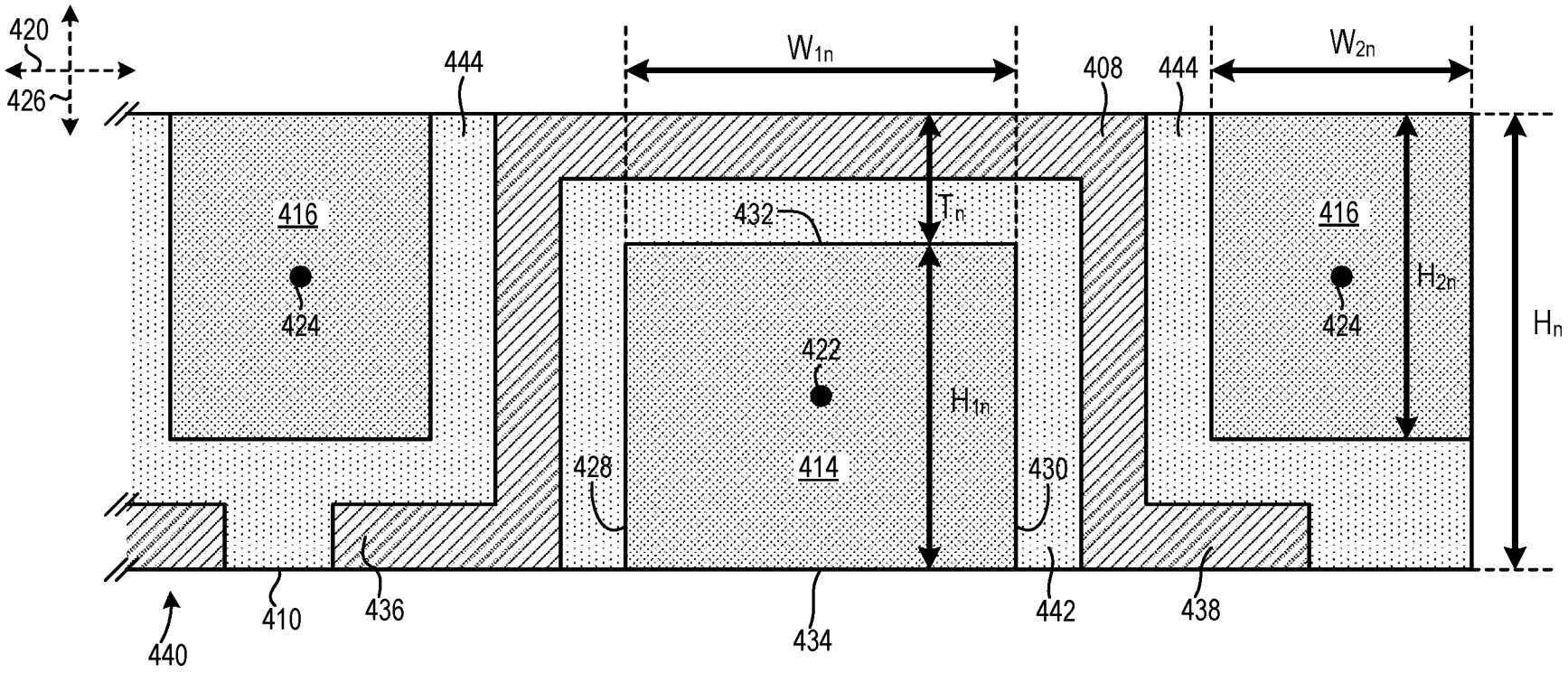
FIG. 9 is a magnified view of a portion of the FIG. 5 cross-sectional view.

FIG. 4 is a top plan view of a low-height coupled inductor 400, which is one embodiment of the new low-height coupled inductors. FIG. 5 is a cross-sectional view of coupled inductor 400 taken along line 5A-5A of FIG. 4, FIG. 6 is a side elevational view of a side 402 of coupled inductor 400, FIG. 7 is a side elevational view of a side 404 of coupled inductor 400, and FIG. 8 is a bottom plan view of coupled inductor 400. FIG. 9 is a magnified view of a portion 502 of the FIG. 5 cross-sectional view.

Figure 10:
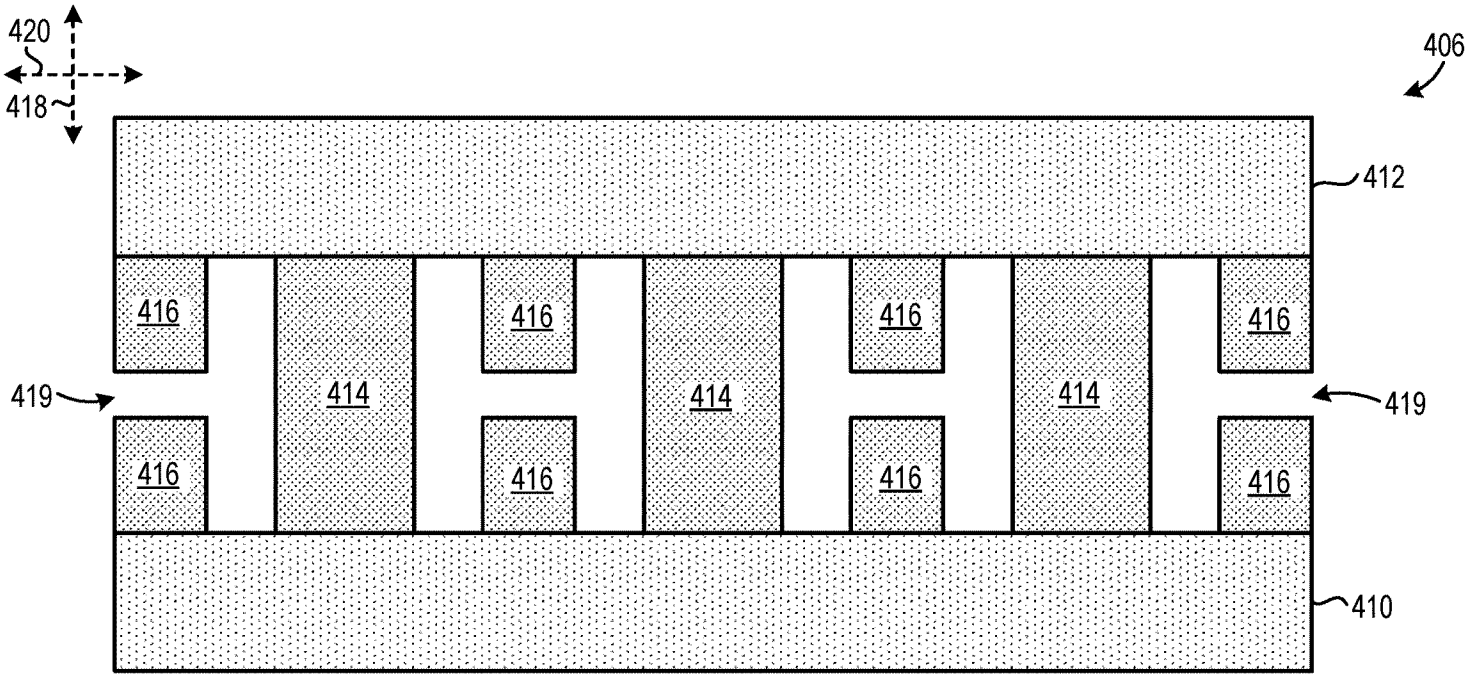
FIG. 10 is a top plan view of a ladder magnetic core of the FIG. 4 coupled inductor.
Figure 11:
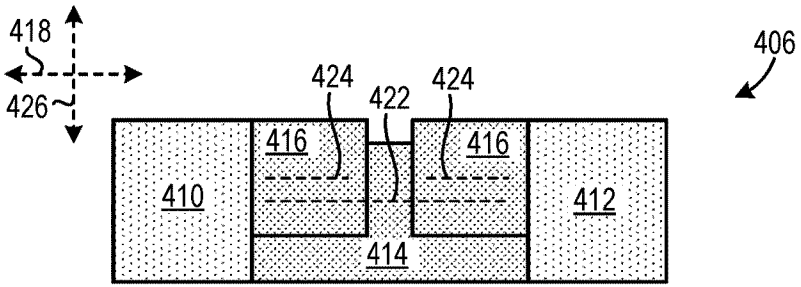
FIG. 11 is a side elevational view of the ladder magnetic core of the FIG. 4 coupled inductor.

Coupled inductor 400 includes a ladder magnetic core 406 and a plurality of windings 408. FIG. 10 is a top plan view of ladder magnetic core 406 without windings 408, and FIG. 11 is a side elevational view of ladder magnetic core 406 without windings 408. Ladder magnetic core 406 includes a first rail 410, a second rail 412, a plurality of rungs 414, and a plurality of leakage teeth 416 (see, e.g., FIGS. 10 and 11). First rail 410 and second rail 412 are separated from each other in a first direction 418, and rungs 414 are separated from each other in a second direction 420, where second direction 420 is orthogonal to first direction 418. Each rung 414 is disposed between first rail 410 and second rail 412 in first direction 418. In some embodiments, each rung 414 joins first rail 410 and second rail 412 in first direction 418, and in some embodiments, rungs 414 are separated from first rail 410 and/or second rails 412 by gaps (not shown).

Each leakage tooth 416 is disposed between first rail 410 and second rail 412 in first direction 418. Leakage teeth 416 provide paths for leakage magnetic flux, and leakage inductance of coupled inductor 400 can accordingly be adjusted during design of coupled inductor 400 by varying the configuration of leakage teeth 416, e.g., by varying cross-sectional area of leakage teeth 416 and/or by varying thickness of gaps 419 between adjacent leakage teeth 416 in first direction 418. For example, leakage inductance can be increased by reducing thickness of gaps 419 in first direction 418 and/or by increasing cross-sectional area of leakage teeth 416. Gaps 419 are filled with a non-magnetic material, or with a magnetic material having a lower magnetic permeability than the magnetic material forming leakage teeth 416, such as air, plastic, glue, paper, or powder iron magnetic material. Only two instances of gaps 419 are labeled to promote illustrative clarity. The number of leakage teeth 416 may vary without departing from the scope hereof.

Rungs 414 are offset from leakage teeth 416 in a third direction 426, where third direction 426 is orthogonal to each of first direction 418 and second direction 420. In particular, each rung 414 has a center axis 422 extending in first direction 418, and each leakage tooth 416 has a center axis 424 extending in first direction 418 (see, e.g., FIGS. 9 and 11). Center axes 422 are offset from center axes 424 in third direction 426. In some embodiments, ladder magnetic core 406 is formed of one or more ferrite magnetic materials.

Each winding 408 is partially wound around a respective rung 414 such that each winding 408 does not overlap with itself when coupled inductor 400 is viewed cross-sectionally in third direction 426. As a result, the plurality of windings 408 form only a single winding layer, as seen when coupled inductor 400 is viewed cross-sectionally in third direction 426. Such feature advantageously promotes small respective aspect ratios of rungs 414 and leakage teeth 416, as discussed below. In some embodiments, each rung 414 includes a first outer surface 428, a second outer surface 430 separated from first outer surface 428 in second direction 420, a third outer surface 432, and a fourth outer surface 434 separated from third outer surface 432 in third direction 426 (see FIG. 9). In certain of these embodiments, each winding 408 is wound around its respective rung 414 such that the winding is not wound around fourth outer surface 434 of the rung. Additionally, in some embodiments, such as illustrated in FIG. 5, each winding 408 is non-overlapping with each other winding 408, as seen when coupled inductor 400 is viewed cross-sectionally in first direction 418. The number of rungs 414 and respective windings 408 in coupled inductor 400 may be varied without departing from the scope hereof.

Figure 12:
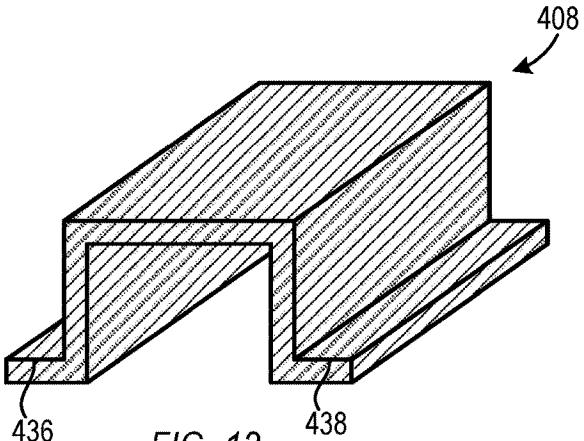
FIG. 12 is a perspective view of a winding of the FIG. 4 coupled inductor.

FIG. 12 is a perspective view of a winding 408 instance separated from the remainder of coupled inductor 400. In some embodiments, each winding 408 forms a first solder tab 436 and a second solder tab 438 that are separated from each other in second direction 420 by a respective rung 414 (see, e.g., FIGS. 5, 8, and 9). First solder tab 436 and second solder tab 438 of each winding 408, for example, extend away in second direction 420 from the respective rung 414 that the winding is partially wound around.

In certain embodiments, each first solder tab 436 and each second solder tab 438 is configured for surface mount soldering to a substrate, e.g., a printed circuit board, adjacent to an outer surface 440, e.g., a bottom outer surface, of coupled inductor 400. In particular embodiments, each winding 408 extends under at least two leakage teeth 416 in third direction 426, and two windings 408 extend under each interior leakage teeth 416, i.e., each leakage tooth 416 not at the ends of coupled inductor 400, in third direction 426. Consequently, in these embodiments, each interior leakage tooth 416 overlaps respective portions of two windings 408, as seen when coupled inductor 400 is viewed cross-sectionally in third direction 426.

Figure 13:
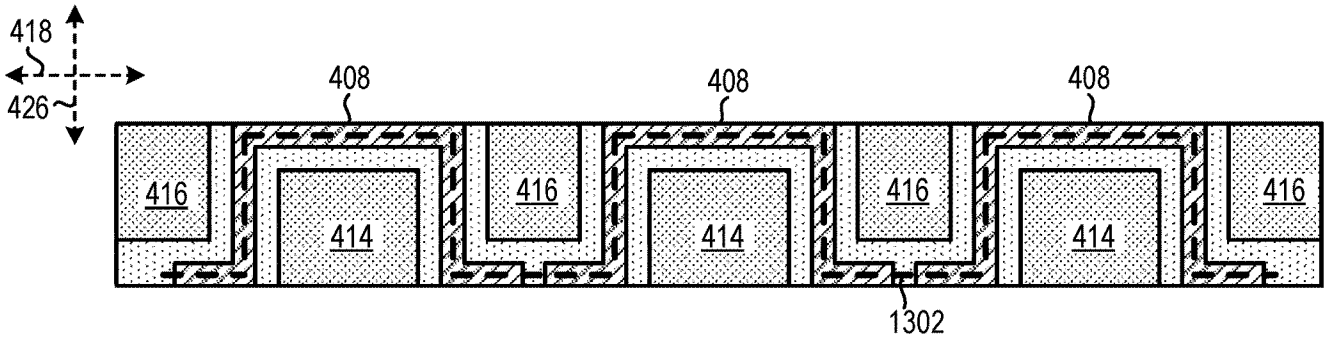
FIG. 13 is a cross-sectional view of the FIG. 4 coupled inductor with a dashed line illustrating a zigzag shape collectively formed by windings of the coupled inductor.

In some embodiments, windings 408 are interleaved between rungs 414 and leakage teeth 416 such that windings 408 collectively form a zigzag shape, as seen when coupled inductor 400 is viewed cross-sectionally in first direction 418. For example, FIG. 13 is a cross-sectional view of coupled inductor 400 analogous to the cross-sectional view of FIG. 5 with a dashed line 1302 illustrating a zigzag shape, e.g., a shape with alternating turns to one side and another side, collectively formed by windings 408.

As illustrated in FIG. 9, each rung 414 has a width $W_{1n}$ and a height $H_{1n}$, each leakage tooth 416 has a width $W_{2n}$ and a height $H_{2n}$, and coupled inductor 400 has a height $H_{1n}$. A portion $T_n$ of coupled inductor height $H_n$ is required for a winding 408 layer, to provide space 442 for the winding 408 layer, to allow for tolerances when assembling coupled inductor 400, and to minimize mechanical stress on rungs 414. Similarly, in some embodiments, there is space 444 between windings 408 and leakage teeth 416. The fact that windings 408 form only a single winding layer advantageously helps minimize the portion of coupled inductor 400 height $H_n$ required for winding 408 layer, and rung height $H_{1n}$ is mathematically specified by EQN. 2 as follows:

$$H_{1n}=H_n-T_n \quad \text{(EQN. 2)}$$

It can be determined by comparing EQNS. 1 and 2 that for a given rung cross-sectional area and a given leakage tooth cross-sectional area, rung height $H_{1n}$ of coupled inductor 400 is significantly greater than rung height $H_1$ of coupled inductor 100. The larger rung height $H_{1n}$ of coupled inductor 400 advantageously causes rung aspect ratio $AR_{1n}$, i.e., the ratio of rung width $W_{1n}$ to rung height $H_{1n}$ ($W_{1n}/H_{1n}$), to be relatively small. Additionally, each leakage tooth 416 has an aspect ratio $AR_{2n}$, i.e., the ratio of leakage tooth height $H_{2n}$ to leakage tooth width $W_{2n}$ ($H_2n/W_{2n}$), that is significantly smaller than corresponding aspect ratio $AR_2$ of coupled inductor 100. Such relatively small aspect ratios of coupled inductor 400 cause coupled inductor 400 to be significantly easier to manufacture and/or significantly more durable than coupled inductor 100.

Figure 14:
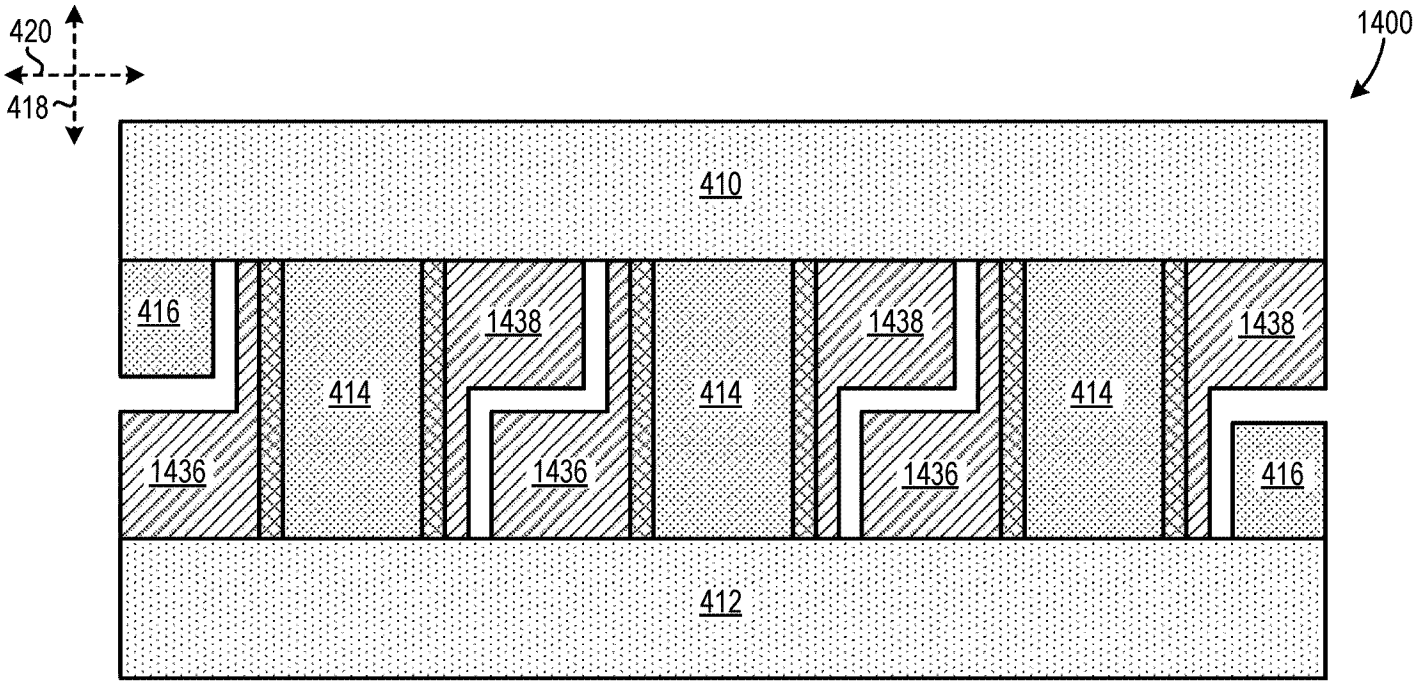
FIG. 14 is a bottom plan view of another low-height coupled inductor, according to an embodiment.
Figure 15:
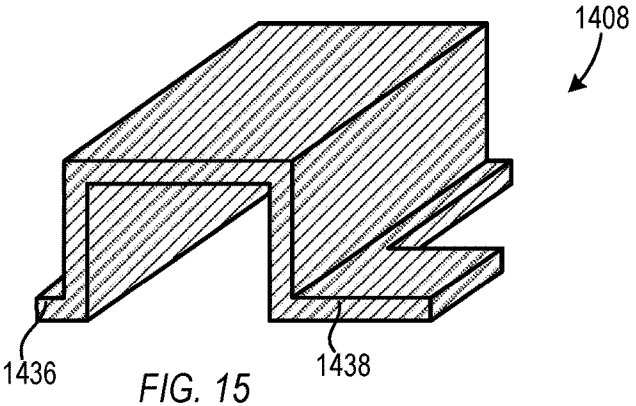
FIG. 15 is a perspective view of a winding of the FIG. 14 coupled inductor.

Windings 408 could be modified without departing from the scope hereof as long as windings 408 form only a single winding layer, as seen when coupled inductor 400 is viewed cross-sectionally in third direction 426. For example, windings 408 could be modified to form different types of solder tabs or to form through-hole posts in place of solder tabs. FIG. 14 illustrates one possible alternative solder tab configuration. In particular, FIG. 14 is a bottom plan view of a low-height coupled inductor 1400, which is similar to coupled inductor 400 but where windings 408 are replaced with windings 1408. FIG. 14 shows outer surface 440 of coupled inductor 1400, although outer surface 440 is not labeled in FIG. 14 to promote illustrate clarity. FIG. 15 is a perspective view of a winding 1408 instance separated from the remainder of coupled inductor 1400. Each winding 408 forms a first solder tab 1436 and a second solder tab 1438 that are separated from each other in second direction 420 by a respective rung 414. First solder tab 1436 and second solder tab 1438 of each winding 1408 extend away in second direction 420 from the respective rung 414 that the winding is partially wound around. Each first solder tab 1436 has a first shape, e.g., a first L-shape, and each second solder tab 1438 has a second shape, e.g., a second L-shape, as seen when outer surface 440 of coupled inductor 1400 is viewed in third direction 426. The second shape of second solder tabs 1438 is a mirror image of the first shape of first solder tabs 1436, to help maximize solder tab surface area along outer surface 440 and thereby promote a low-resistance connection from the solder tabs to a substrate.

Figure 23:
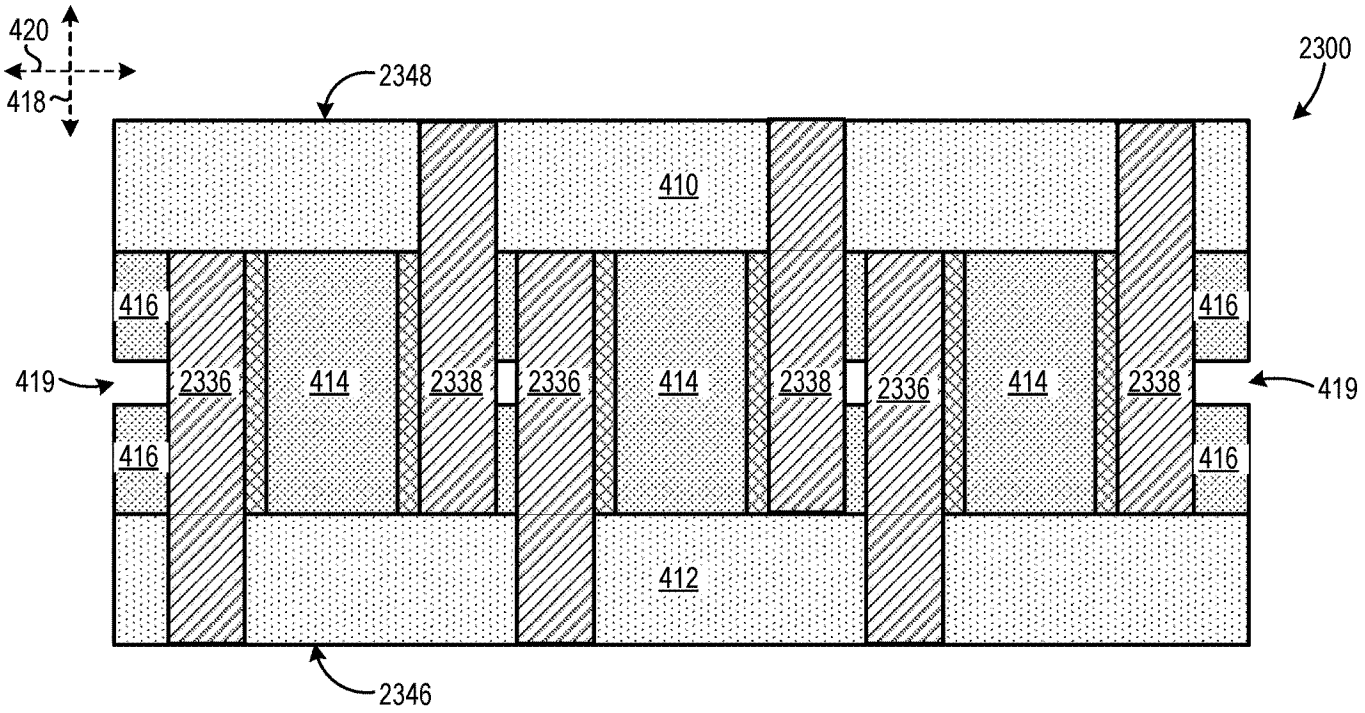
FIG. 23 is a bottom plan view of another low-height coupled inductor, according to an embodiment.
Figure 24:
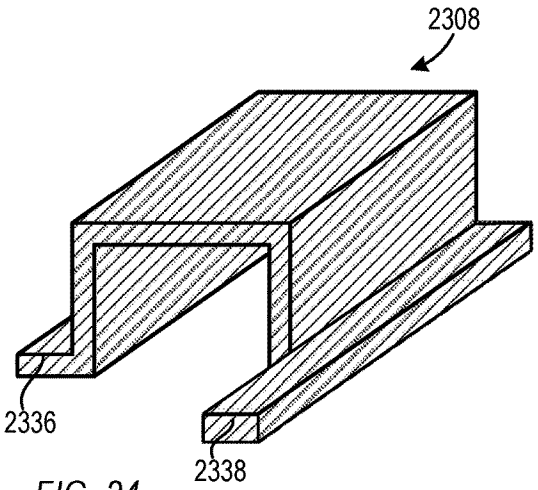
FIG. 24 is a perspective view of a winding of the FIG. 23 coupled inductor.

FIG. 23 illustrates another possible alternative winding configuration. FIG. 23 is a bottom plan view of a low-height coupled inductor 2300, which is similar to coupled inductor 400 but where windings 408 are replaced with windings 2308. FIG. 23 shows outer surface 440 of coupled inductor 1400, although outer surface 440 is not labeled in FIG. 23 to promote illustrate clarity. FIG. 24 is a perspective view of a winding 2308 instance separated from the remainder of coupled inductor 2300. Each winding 2308 forms a first solder tab 2336 and a second solder tab 2338 that are separated from each other in second direction 420 by a respective rung 414. Each first solder tab 2336 extends in first direction 418 to an edge 2346 of coupled inductor 2300, and each second solder tab 2338 extends in first direction 418 to an edge 2348 of coupled inductor 2300, where edges 2346 and 2348 are separated from each other in first direction 418.

Figure 25:
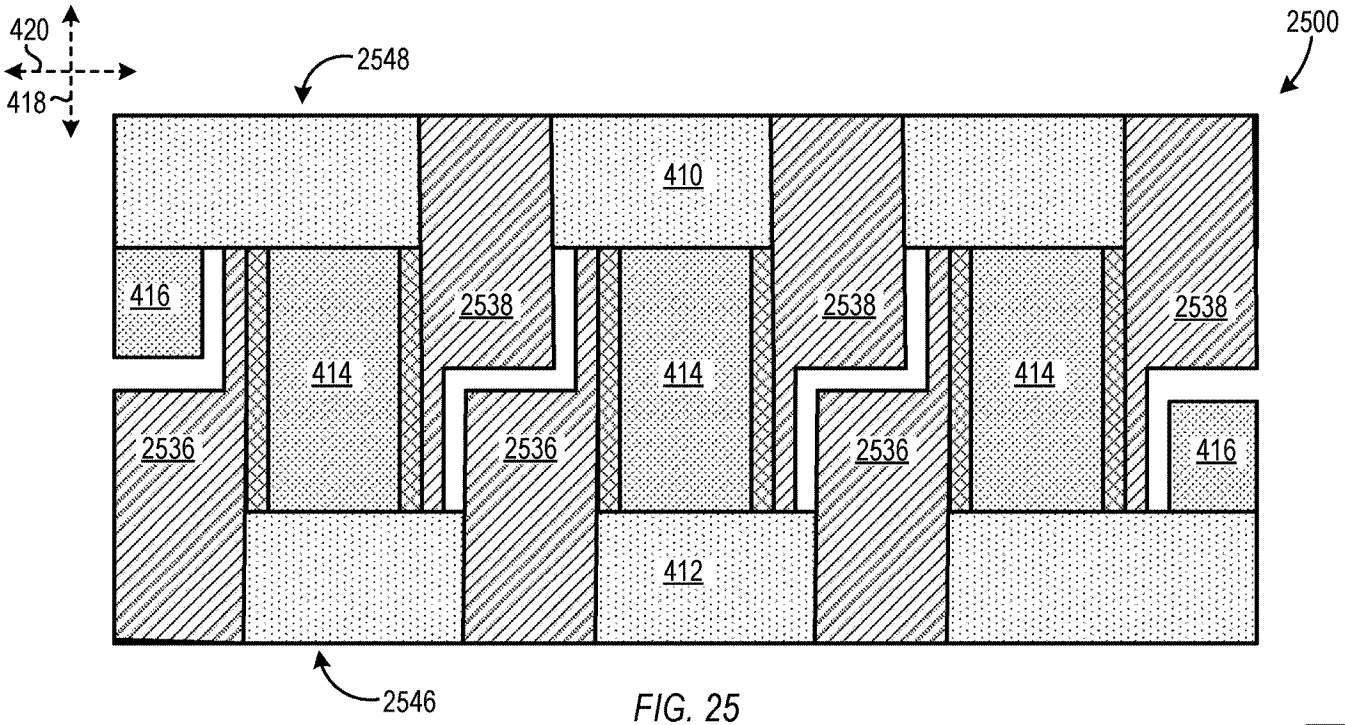
FIG. 25 is a bottom plan view of another low-height coupled inductor, according to an embodiment.
Figure 26:
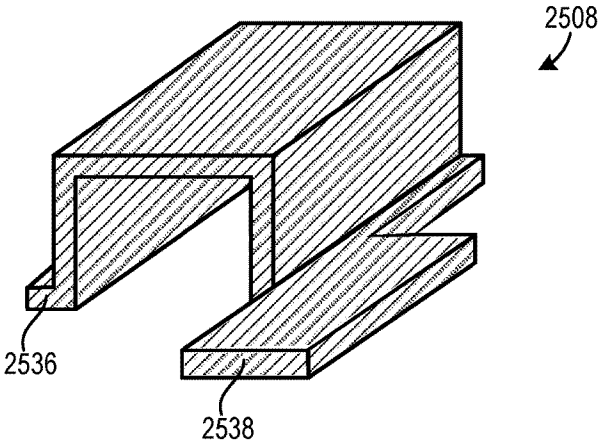
FIG. 26 is a perspective view of a winding of the FIG. 25 coupled inductor.

FIG. 25 illustrates yet another possible alternative winding configuration. FIG. 25 is a bottom plan view of a low-height coupled inductor 2500, which is similar to coupled inductor 1400 but where windings 1408 are replaced with windings 2508. FIG. 25 shows outer surface 440 of coupled inductor 2500, although outer surface 440 is not labeled in FIG. 25 to promote illustrate clarity. FIG. 26 is a perspective view of a winding 2508 instance separated from the remainder of coupled inductor 2500. Each winding 2508 forms a first solder tab 2536 and a second solder tab 2538 that are separated from each other in second direction 420 by a respective rung 414. Each first solder tab 2536 extends in first direction 418 to an edge 2546 of coupled inductor 2500, and each second solder tab 2538 extends in first direction 418 to an edge 2548 of coupled inductor 2500, where edges 2546 and 2548 are separated from each other in first direction 418.

Figure 16:
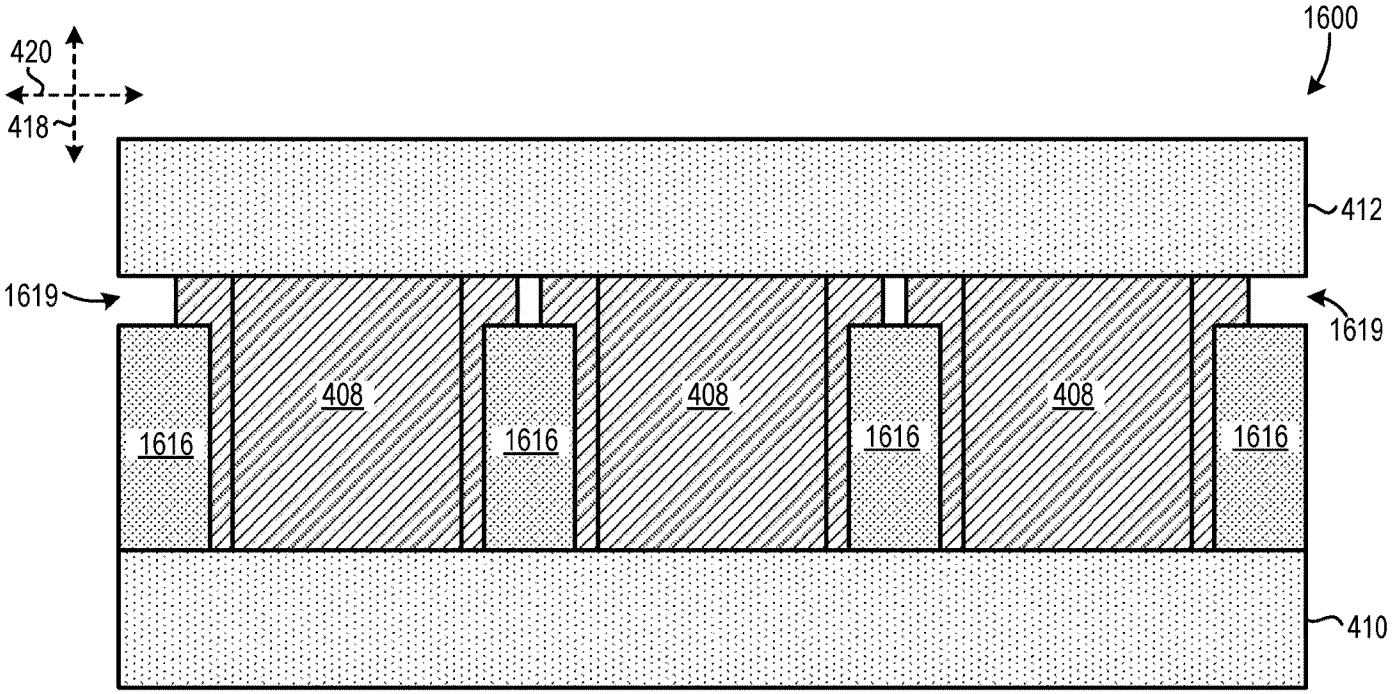
FIG. 16 is a top plan view of another low-height coupled inductor, according to an embodiment.

The low-height coupled inductors disclosed herein could be modified to have a different number of leakage teeth 416 and/or a different configuration of leakage teeth 416. For example, FIG. 16 is a top plan view of a coupled inductor 1600, which is similar to coupled inductor 400, but with leakage teeth 416 replaced with leakage teeth 1616. Each leakage tooth 1616 bridges a majority of the separation distance between first rail 410 and second rail 412 in first direction 418, but each leakage tooth 1616 is separated from second rail 412 by a respective gap 1619 filled with a non-magnetic material, or with a magnetic material having a lower magnetic permeability than the magnetic material forming leakage teeth 1616, such as air, plastic, glue, paper, or powder iron magnetic material. Only two instances of gap 1619 are labeled in FIG. 16 to promote illustrative clarity.

Figure 17:
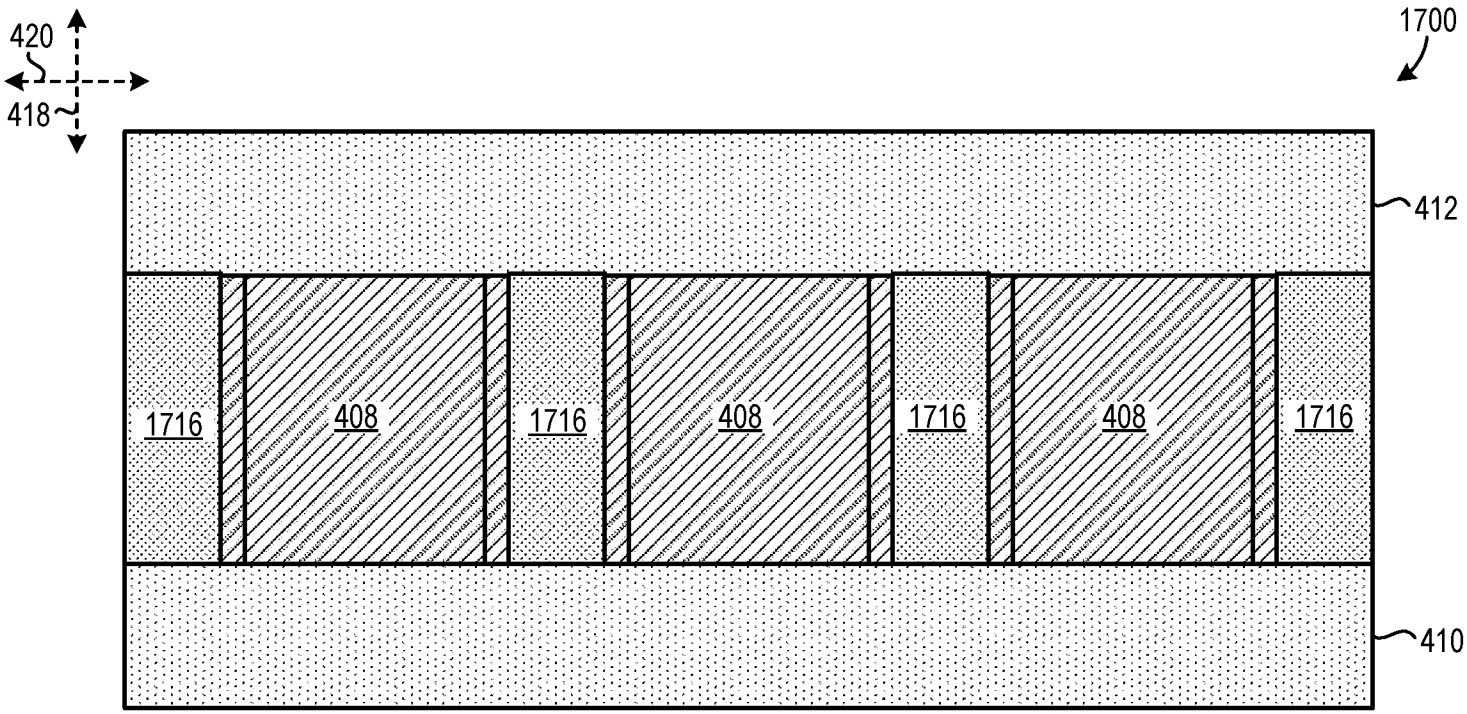
FIG. 17 is a top plan view of yet another low-height coupled inductor, according to an embodiment.
Figure 18:
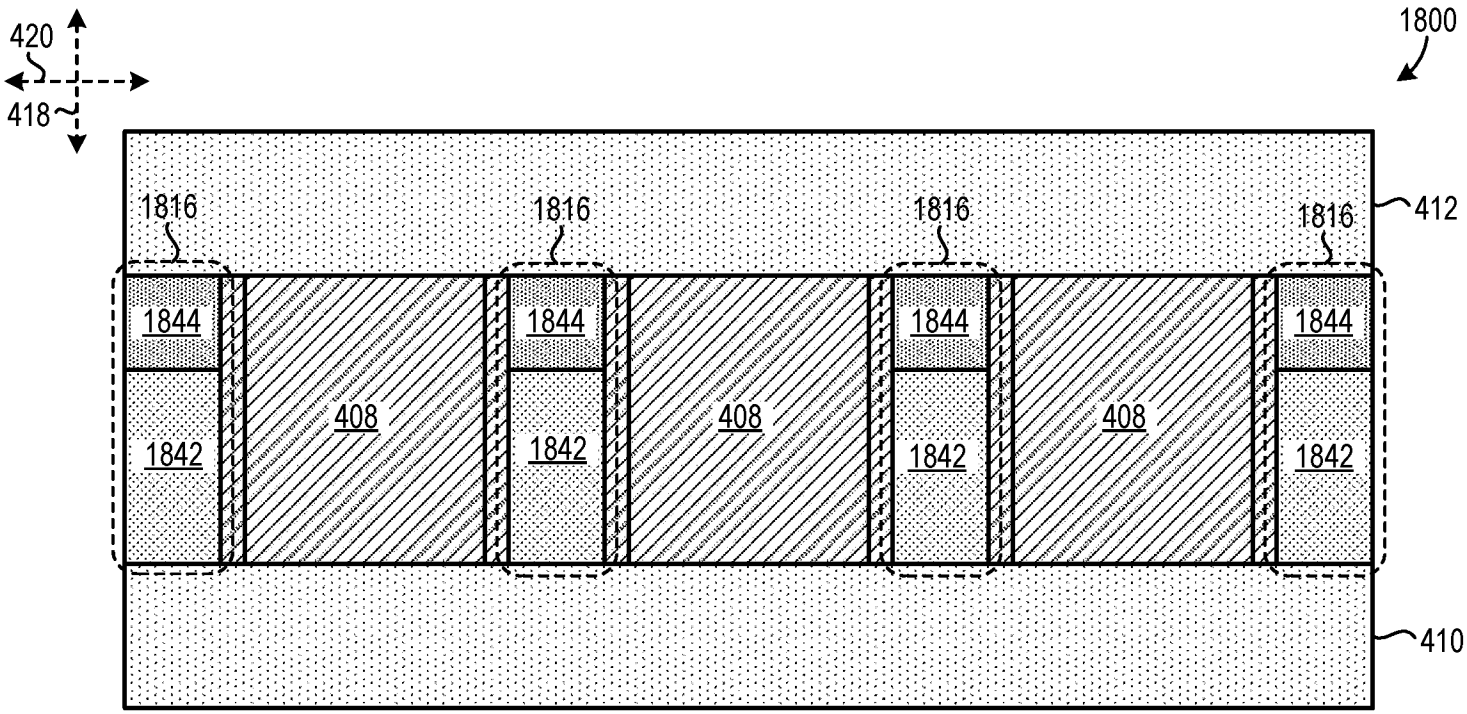
FIG. 18 is a top plan view of a low-height coupled inductor including leakage teeth formed of two different magnetic materials, according to an embodiment.

As another example, FIG. 17 is a top plan view of a coupled inductor 1700, which is similar to coupled inductor 400, but with leakage teeth 416 replaced with leakage teeth 1716. Each leakage tooth 1716 bridges the entire separation distance between first rail 410 and second rail 412 in first direction 418. Although each leakage tooth 1716 is a single element in the FIG. 17 example, in some alternate embodiments, each leakage tooth includes two or more elements. For example, FIG. 18 is a top plan view of a coupled inductor 1800, which is similar to coupled inductor 1700 but with leakage teeth 1716 replaced with leakage teeth 1816. Each leakage tooth 1816 includes a first portion 1842 and a second portion 1844 formed of different respective magnetic materials. For example, in particular embodiments, each first portion 1842 is formed of a ferrite magnetic material, and each second portion 1844 is formed of a composite material, e.g., powder iron in a binder. Second portion 1844 is optionally formed after windings 408 are wound on rungs 414, such as to minimize mechanical stress on ferrite magnetic elements of coupled inductor 1800's magnetic core and/or to secure together two or more elements of coupled inductor 1800, to further promote durability of the coupled inductor.

Figure 19:
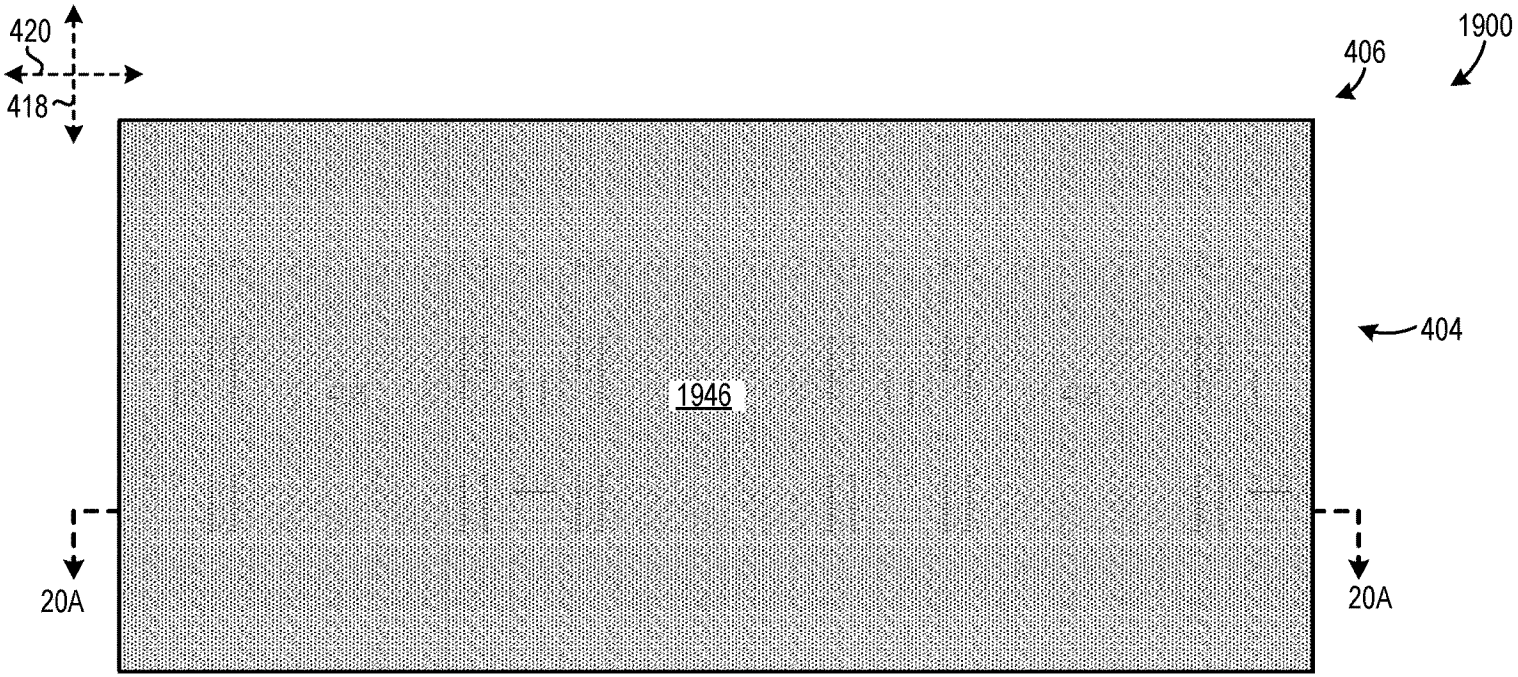
FIG. 19 is a top plan view of a low-height coupled inductor including a top magnetic layer, according to an embodiment.
Figure 20:
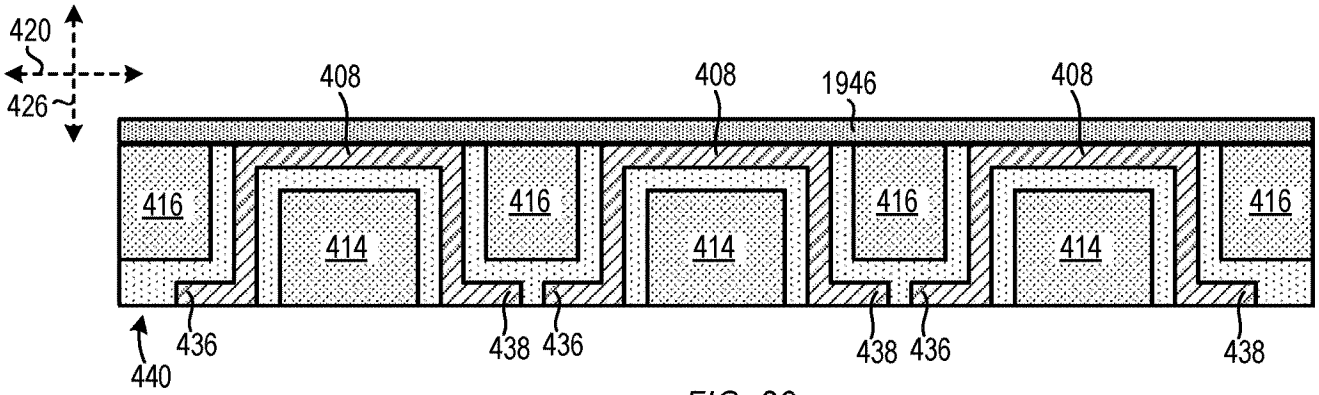
FIG. 20 is a cross-sectional view of the FIG. 19 coupled inductor.
Figure 21:
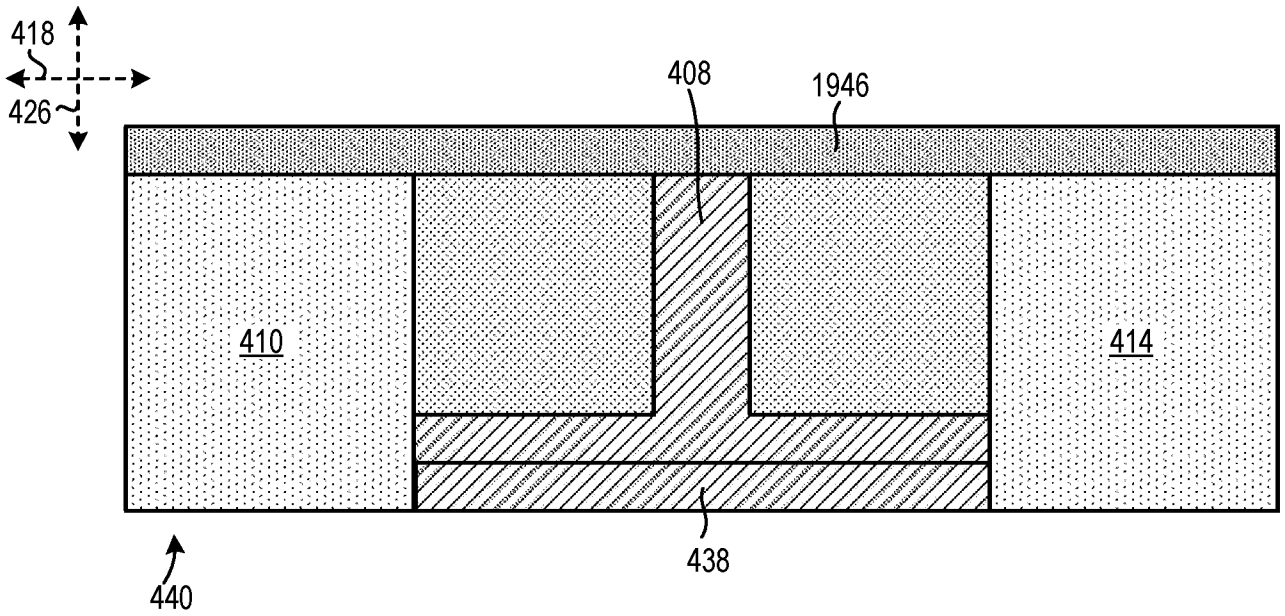
FIG. 21 is a side elevational view of the FIG. 19 coupled inductor.

Any of the low-height coupled inductors disclosed herein could be modified to further include a top magnetic layer, such as to help minimize core losses, winding eddy current losses, and/or potential for electromagnetic interference. For example, FIG. 19 is a top plan view of a low-height coupled inductor 1900, which is similar to coupled inductor 400, but with a top magnetic layer 1946 disposed over ladder magnetic core 406 and windings 408 in third direction 426. FIG. 20 is a cross-sectional view of coupled inductor 1900 taken along line 20A-20A of FIG. 19, and FIG. 21 is a side elevational view of side 404 of coupled inductor 1900. Top magnetic layer 1946 is formed of magnetic material, such as powder iron within a binder. FIG. 21 is magnified relative to FIGS. 19 and 20. Top magnetic layer 1946 helps contain magnetic flux within coupled inductor 1900, thereby promoting electromagnetic compatibility of coupled inductor 1900 with external devices. Additionally, top magnetic layer 1946 helps direct magnetic flux away from windings 408, thereby helping minimize eddy current losses within the windings. Additionally, top magnetic layer 1946 reduces reluctance of leakage magnetic flux paths, which helps minimize core losses. In some embodiments, top magnetic layer 1946 is formed of a different magnetic material than leakage teeth 416, while in some other embodiments, top magnetic element 1946 is formed of the same magnetic material as leakage teeth 416. In embodiments where top magnetic element 1946 is formed of the same magnetic material as leakage teeth 416, top magnetic element 1946 is optionally formed at the same time as leakage teeth 416.

Figure 27:
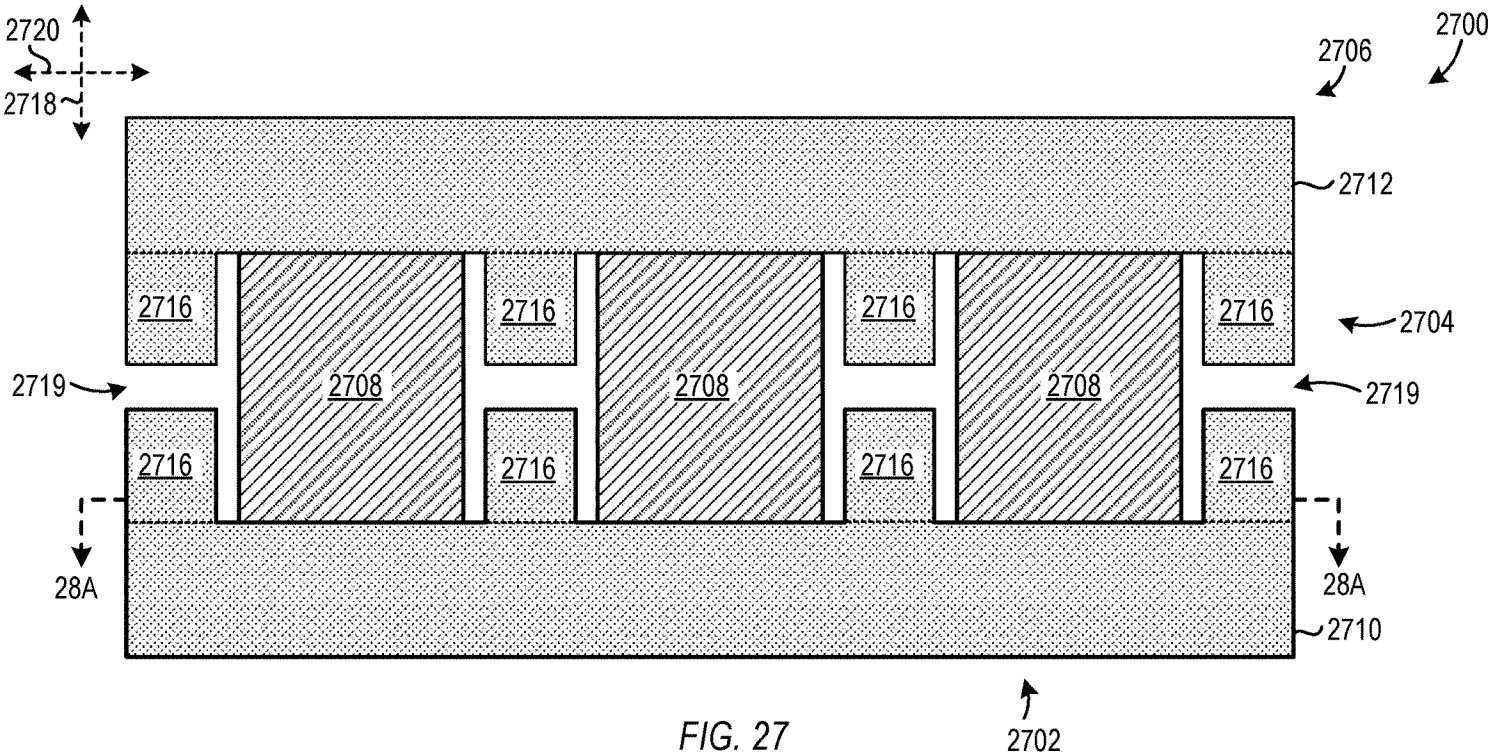
FIG. 27 is a top plan view of another low-height coupled inductor, according to an embodiment.
Figure 28:
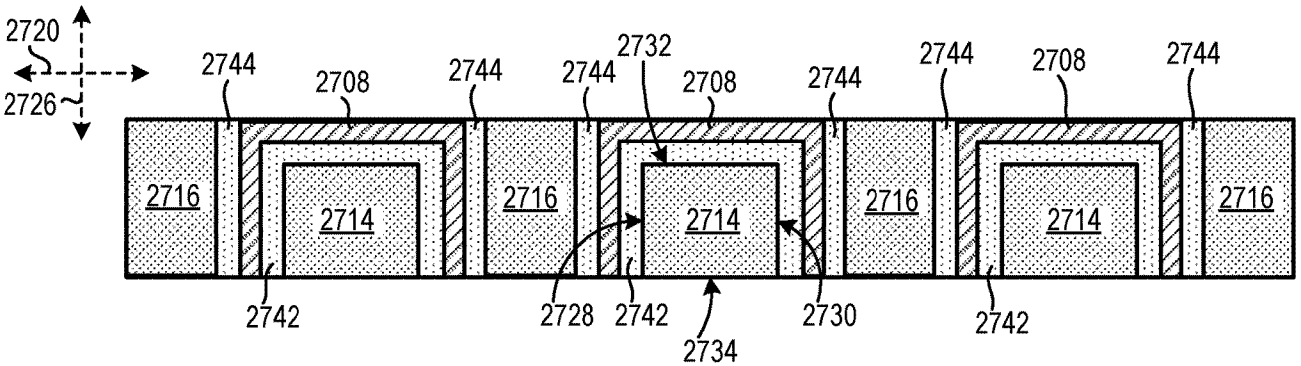
FIG. 28 is a cross-sectional view of the FIG. 27 coupled inductor.
Figure 29:
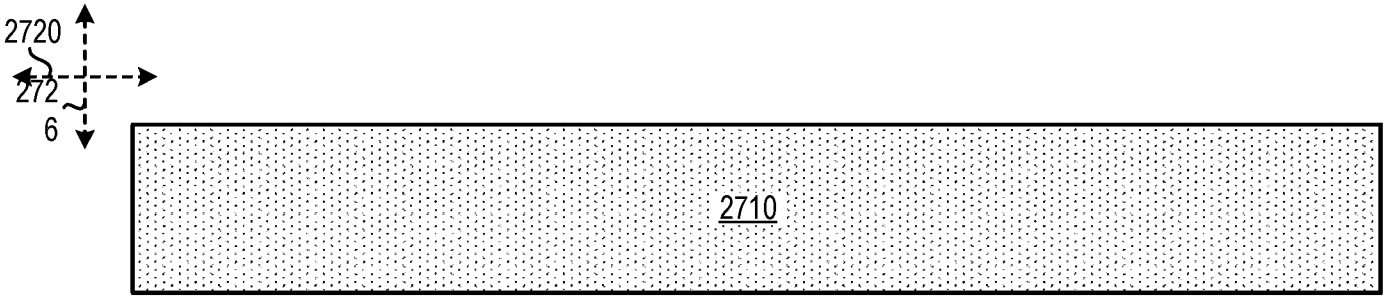
FIG. 29 is a side elevational view of the FIG. 27 coupled inductor.
Figure 30:
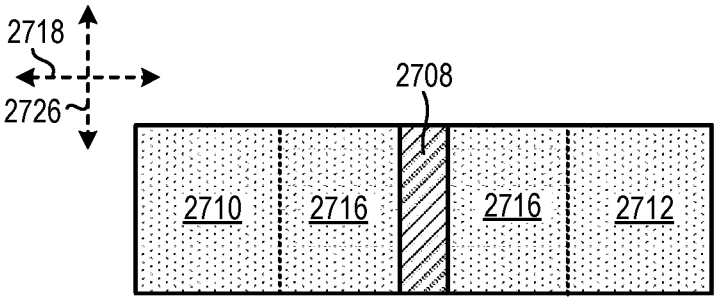
FIG. 30 is another side elevational view of the FIG. 27 coupled inductor.
Figure 31:
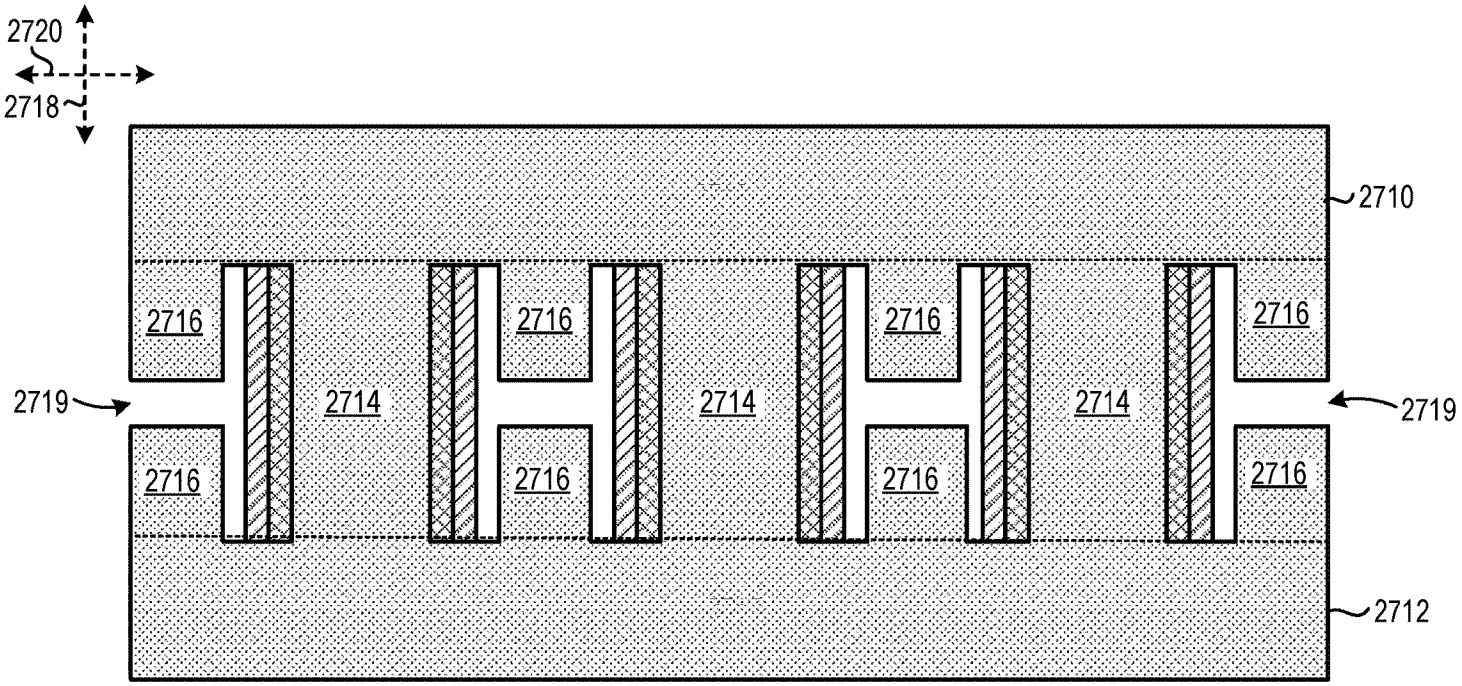
FIG. 31 is a bottom plan view of the FIG. 27 coupled inductor.

FIGS. 27-31 illustrate another low-height coupled inductor developed by Applicant. Specifically, FIG. 27 is a top plan view of a low-height coupled inductor 2700, FIG. 28 is a cross-sectional view of coupled inductor 2700 taken along line 28A-28A of FIG. 27, FIG. 29 is a side elevational view of a side 2702 of coupled inductor 2700, FIG. 30 is a side elevational view of a side 2704 of coupled inductor 2700, and FIG. 31 is a bottom plan view of coupled inductor 2700.

Figure 33:
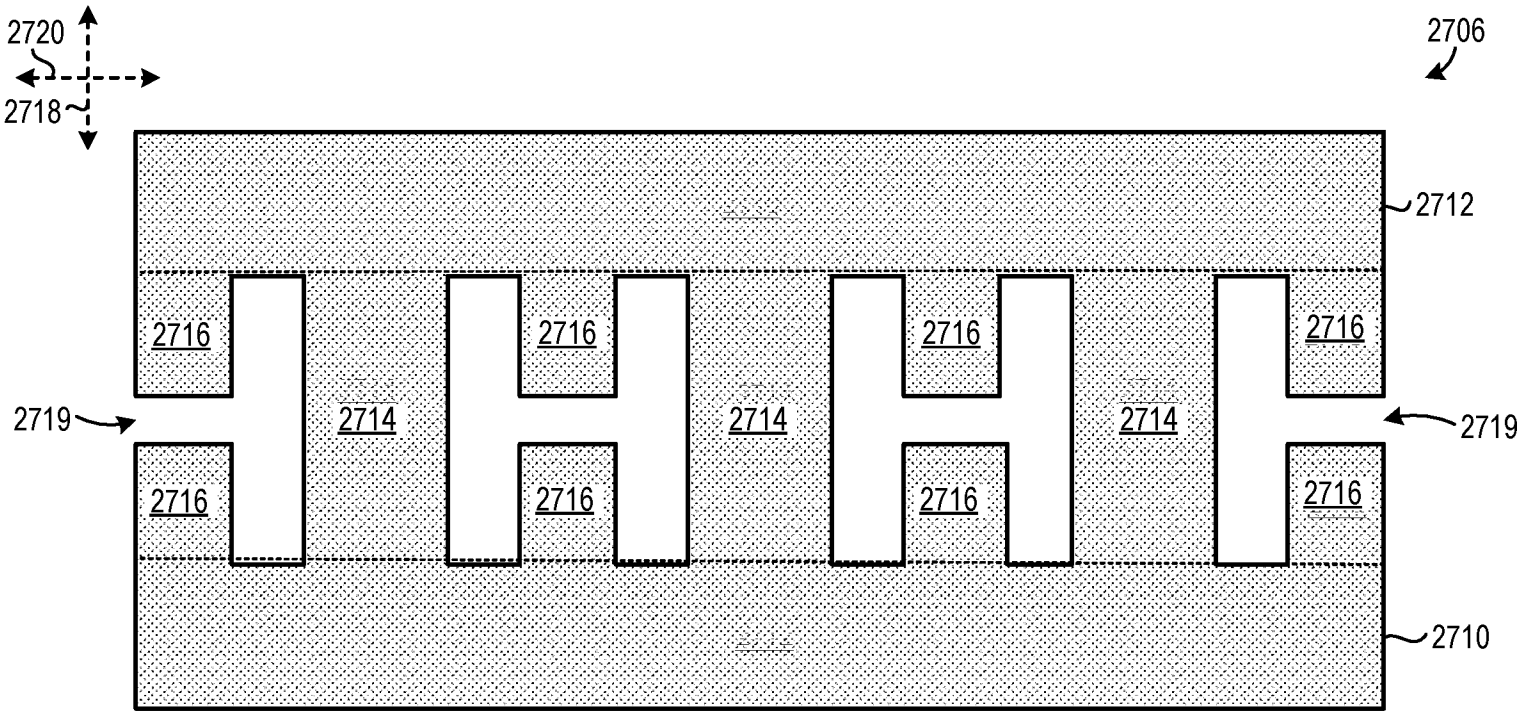
FIG. 33 is a top plan view of a ladder magnetic core of the FIG. 27 coupled inductor.

Coupled inductor 2700 includes a ladder magnetic core 2706 and a plurality of windings 2708. FIG. 33 is a top plan view of ladder magnetic core 2706 without windings 2708. Ladder magnetic core 2706 includes a first rail 2710, a second rail 2712, a plurality of rungs 2714, and a plurality of leakage teeth 2716 (see, e.g., FIG. 33). First rail 2710 and second rail 2712 are separated from each other in a first direction 2718, and rungs 2714 are separated from each other in a second direction 2720, where second direction 2720 is orthogonal to first direction 2718. Each rung 2714 is disposed between first rail 2710 and second rail 2712 in first direction 2718. In some embodiments, each rung 2714 joins first rail 2710 and second rail 2712 in first direction 2718, and in some embodiments, rungs 2714 are separated from first rail 2710 and/or second rails 412 by gaps (not shown).

Each leakage tooth 2716 is disposed between first rail 2710 and second rail 2712 in first direction 2718. Leakage teeth 2716 provide paths for leakage magnetic flux, and leakage inductance of coupled inductor 2700 can accordingly be adjusted during design of coupled inductor 2700 by varying the configuration of leakage teeth 2716, e.g., by varying cross-sectional area of leakage teeth 2716 and/or by varying thickness of gaps 2719 between adjacent leakage teeth 2716 in first direction 2718. For example, leakage inductance can be increased by reducing thickness of gaps 2719 in first direction 2718 and/or by increasing cross-sectional area of leakage teeth 2716. Gaps 2719 are filled with a non-magnetic material, or with a magnetic material having a lower magnetic permeability than the magnetic material forming leakage teeth 2716, such as air, plastic, glue, paper, or powder iron magnetic material. Only two instances of gaps 2719 are labeled to promote illustrative clarity. The number of leakage teeth 2716 may vary without departing from the scope hereof.

Although various elements of ladder magnetic core 2706 are delineated by dashed lines in the present figures to help a viewer distinguish the elements of magnetic core 2706, the dashed lines need not represent discontinuities in magnetic core 2706. In some embodiments, ladder magnetic core 2706 is formed of one or more ferrite magnetic materials.

Each winding 2708 is partially wound around a respective rung 2714 such that each winding 2708 does not overlap with itself when coupled inductor 2700 is viewed cross-sectionally in third direction 2726. As a result, the plurality of windings 2708 form only a single winding layer, as seen when coupled inductor 2700 is viewed cross-sectionally in third direction 2726. Such feature advantageously promotes small respective aspect ratios of rungs 2714 and leakage teeth 2716, in a manner analogous to that discussed above with respect to low-height coupled inductor 400. In some embodiments, there is a space 2742 between rungs 2714 and winding 2708 to allow for tolerances when assembling coupled inductor 2700, and to minimize mechanical stress on rungs 2714. Similarly, in some embodiments, there is space 2744 between windings 2708 and leakage teeth 2716.

In certain embodiments, each rung 2714 includes a first outer surface 2728, a second outer surface 2730 separated from first outer surface 2728 in second direction 2720, a third outer surface 2732, and a fourth outer surface 2734 separated from third outer surface 2732 in third direction 2726 (see FIG. 28). In certain of these embodiments, each winding 2708 is wound around its respective rung 2714 such that the winding is not wound around fourth outer surface 2734 of the rung. Additionally, in some embodiments, such as illustrated in FIG. 28, each winding 2708 is non-overlapping with each other winding 2708, as seen when coupled inductor 2700 is viewed cross-sectionally in first direction 2718. The number of rungs 2714 and respective windings 2708 in coupled inductor 2700 may be varied without departing from the scope hereof.

Figure 32:
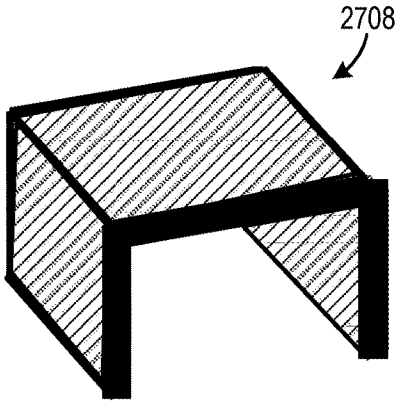
FIG. 32 is a perspective view of a winding of the FIG. 27 coupled inductor.

FIG. 32 is a perspective view of a winding 2708 instance separated from the remainder of coupled inductor 2700. Windings 2708 do not form solder tabs extending away from the winding, which advantageously promotes a large magnetic core material to volume ratio of coupled inductor 2700, thereby helping minimize required size of the low-height coupled inductor.

Figure 34:
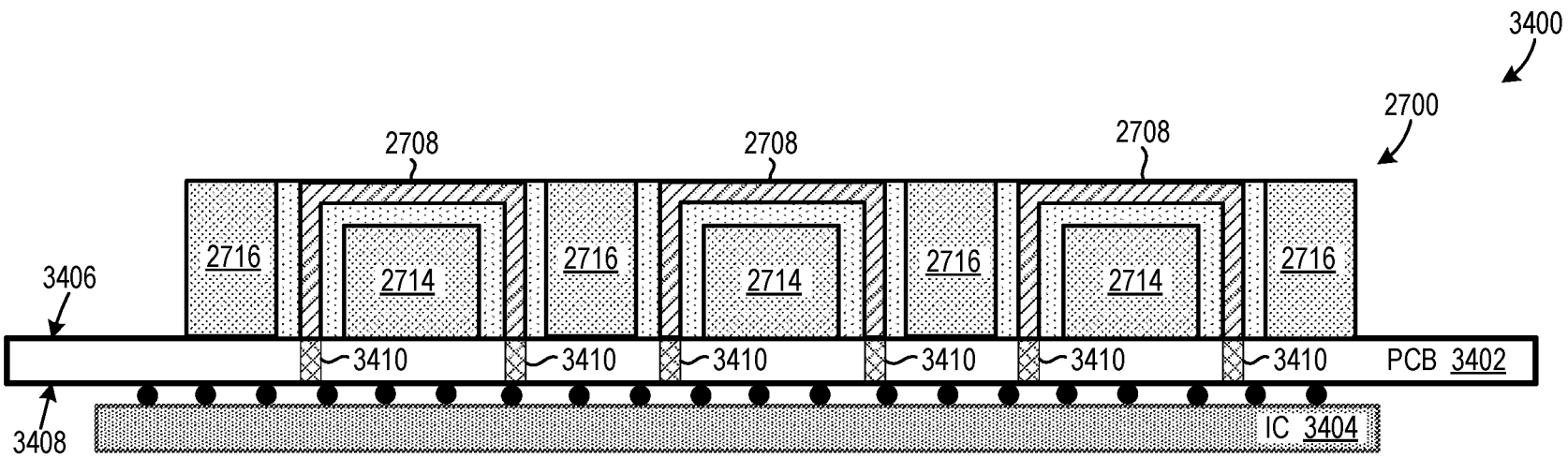
FIG. 34 is a cross-sectional view of a printed circuit assembly including an instance of the FIG. 27 coupled inductor, according to an embodiment.

The configuration of low-height coupled inductor 2700 may be particularly advantageous in applications where low-height coupled inductor 2700 connects to electrical circuitry below the coupled inductor. For example, FIG. 34 is a cross-sectional view of a printed circuit assembly (PCA) 3400 which includes a printed circuit board (PCB) 3402, an instance of low-height coupled inductor 2700, and an integrated circuit (IC) 3404. In some embodiments of PCA 3400, low-height coupled inductor 2700 is a component of power conversion circuitry, and IC 3404 is a load powered by the power conversion circuitry. In some other embodiments of PCA 3400, low-height coupled inductor 2700 is a component of power conversion circuitry, and IC 3404 is another component of the power conversion circuitry, such as an IC including multiple switching stages and a controller.

Low-height coupled inductor 2700 is mounted to a first side 3406 of PCB 3402, and IC 3404 is mounted to an opposing second side 3408 of PCB 3402. The configuration of windings 2708 advantageously enables a short connection between the windings and IC 3404 using through-hole vias 3410 extending from PCB first side 3406 to PCB second side 3408.

Figure 35:
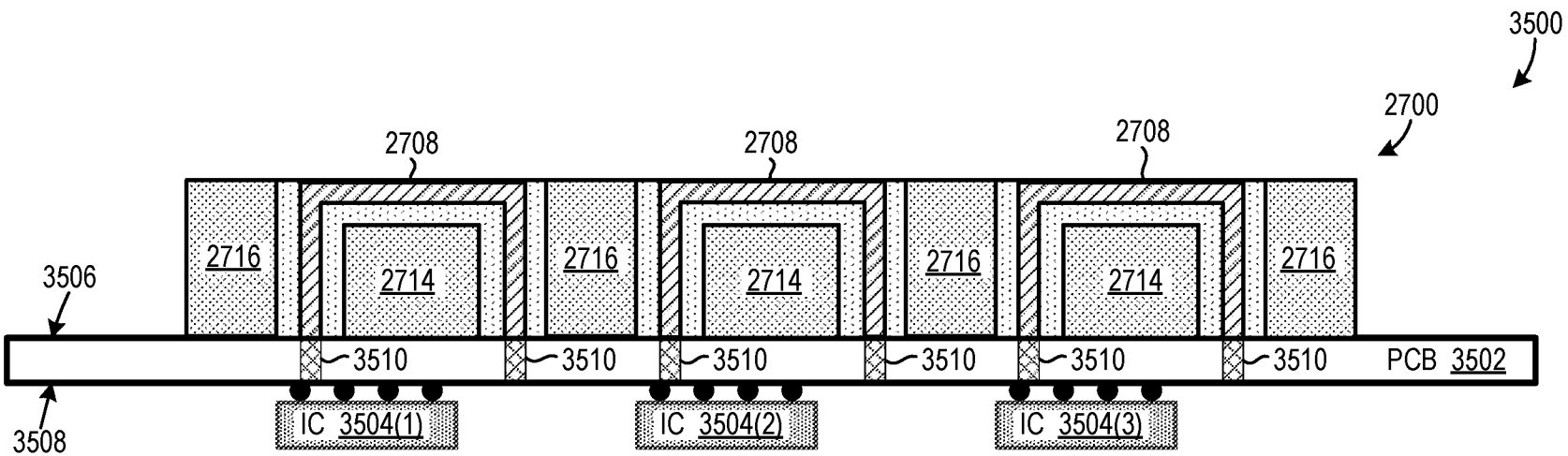
FIG. 35 is a cross-sectional view of another printed circuit assembly including an instance of the FIG. 27 coupled inductor, according to an embodiment.

FIG. 35 is a cross-sectional view of a PCA 3500, which includes a PCB 3502, another instance of low-height coupled inductor 2700, and a respective IC 3504 for each winding 2708 of low-height coupled inductor 2700. In some embodiments of PCA 3500, low-height coupled inductor 2700 is a component of power conversion circuitry, and each IC 3504 includes a switching stage for a respective winding 2708 of low-height coupled inductor 2700.

Low-height coupled inductor 2700 is mounted to a first side 3506 of PCB 3502, and each IC 3504 is mounted to an opposing second side 3508 of PCB 3502. The configuration of windings 2708 advantageously enables a short connection between the windings and ICs 3504 using through-hole vias 3510 extending from PCB first side 3506 to PCB second side 3508.

Figure 22:
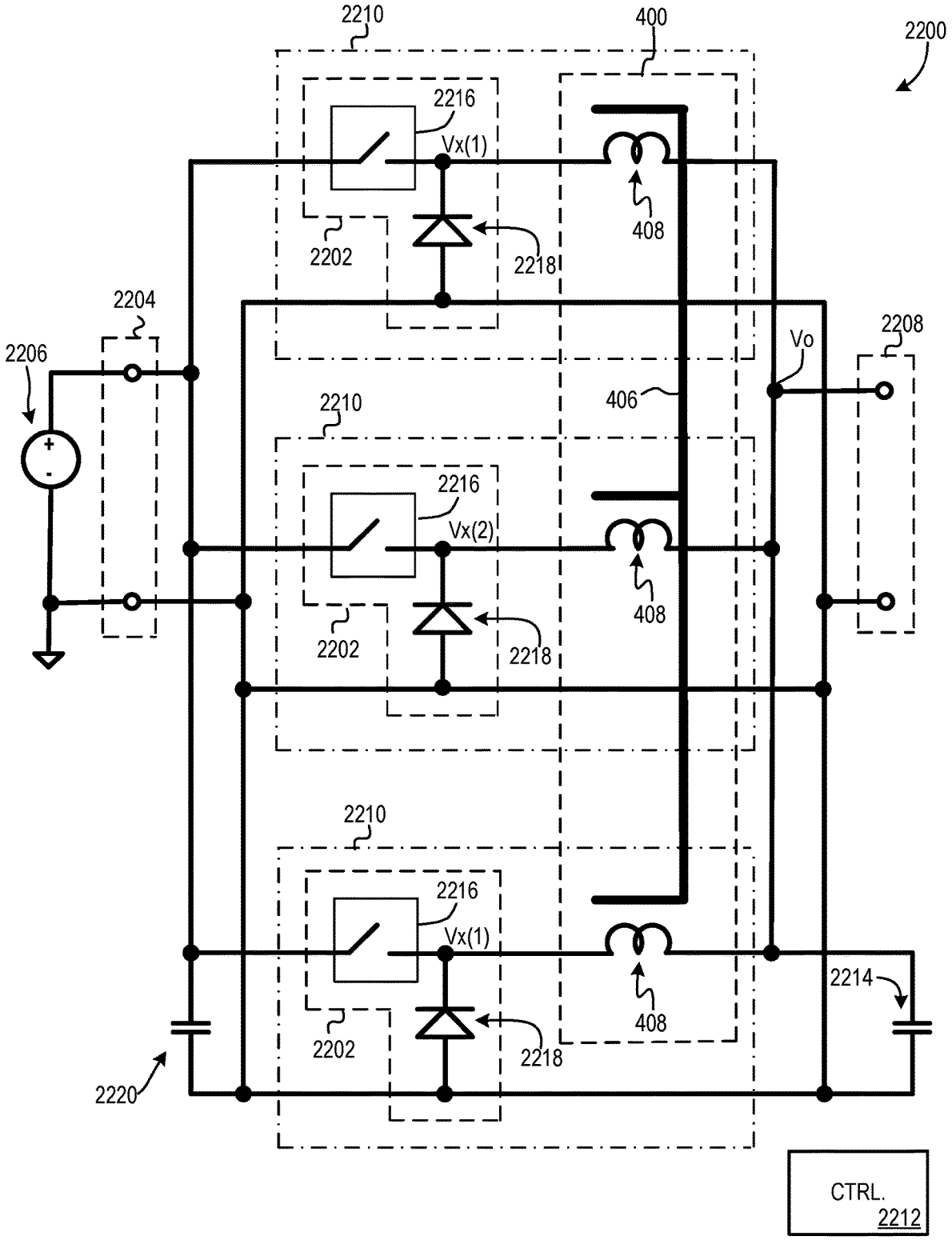
FIG. 22 illustrates a multi-phase buck switching power converter including an instance of the FIG. 4 coupled inductor, according to an embodiment.

One possible application of the low-height coupled inductors disclosed herein is in multi-phase switching power converter applications, including but not limited to, multi-phase buck converter applications, multi-phase boost converter applications, or multi-phase buck-boost converter applications. For example, FIG. 22 schematically illustrates one possible use of coupled inductor 400 (FIG. 4) in a multi-phase buck converter 2200. Each winding 408 is electrically coupled between a respective switching node $V_x$ and a common output node $V_o$. A respective switching circuit 2202 is electrically coupled to each switching node $V_x$. Each switching circuit 2202 is electrically coupled to an input port 2204, which is in turn electrically coupled to an electric power source 2206. An output port 2208 is electrically coupled to output node $V_o$. Each switching circuit 2202 and respective inductor is collectively referred to as a "phase" 2210 of the converter. Thus, multi-phase buck converter 2200 is a three-phase converter.

A controller 2212 causes each switching circuit 2202 to repeatedly switch its respective winding end between electric power source 2206 and ground, thereby switching its winding end between two different voltage levels, to transfer power from electric power source 2206 to a load (not shown) electrically coupled across output port 2208. Controller 2212 typically causes switching circuits 2202 to switch at a relatively high frequency, such as at 100 kilohertz or greater, to promote low ripple current magnitude and fast transient response, as well as to ensure that switching induced noise is at a frequency above that perceivable by humans. Additionally, in certain embodiments, controller 2212 causes switching circuits 2202 to switch out-of-phase with respect to each other in the time domain to improve transient response and promote ripple current cancelation in output capacitors 2214.

Each switching circuit 2202 includes a control switching device 2216 that alternately switches between its conductive and non-conductive states under the command of controller 2212. Each switching circuit 2202 further includes a freewheeling device 2218 adapted to provide a path for current through its respective winding 408 when the control switching device 2216 of the switching circuit transitions from its conductive to non-conductive state. Freewheeling devices 2218 may be diodes, as shown, to promote system simplicity. However, in certain alternate embodiments, freewheeling devices 2218 may be supplemented by or replaced with a switching device operating under the command of controller 2212 to improve converter performance. For example, diodes in freewheeling devices 2218 may be supplemented by switching devices to reduce freewheeling device 2218 forward voltage drop. In the context of this disclosure, a switching device includes, but is not limited to, a bipolar junction transistor, a field effect transistor (e.g., a N-channel or P-channel metal oxide semiconductor field effect transistor, a junction field effect transistor, a metal semiconductor field effect transistor), an insulated gate bipolar junction transistor, a thyristor, or a silicon controlled rectifier.

Controller 2212 is optionally configured to control switching circuits 2202 to regulate one or more parameters of multi-phase buck converter 2200, such as input voltage, input current, input power, output voltage, output current, or output power. Buck converter 2200 typically includes one or more input capacitors 2220 electrically coupled across input port 2204 for providing a ripple component of switching circuit 2202 input current. Additionally, one or more output capacitors 2214 are generally electrically coupled across output port 2208 to shunt ripple current generated by switching circuits 2202.

Buck converter 2200 could be modified to have a different number of phases. For example, converter 2200 could be modified to have four phases and to use an embodiment of coupled inductor 400 including four rungs 414 and four windings 408. Buck converter 2200 could also be modified to use one of the other coupled inductors disclosed herein, such as coupled inductor 1400, 1600, 1700, 1800, 1900, 2300, 2500, or 2700. Additionally, buck converter 2200 could also be modified to have a different multi-phase switching power converter topology, such as that of a multi-phase boost converter or a multi-phase buck-boost converter, or an isolated topology, such as a flyback or forward converter without departing from the scope hereof.

Combinations of Features

Features described above may be combined in various ways without departing from the scope hereof. The following examples illustrate some possible combinations:

(A1) A low-height coupled inductor may include a ladder magnetic core and a plurality of windings. The ladder magnetic core may include (1) a first rail and a second rail separated from each other in a first direction, (2) a plurality of rungs separated from each other in a second direction, the second direction being orthogonal to the first direction, each rung of the plurality of rungs being disposed between the first rail and the second rail in the first direction, and (3) a plurality of leakage teeth, each leakage tooth of the plurality of leakage teeth being disposed between the first rail and the second rail in the first direction. Each of the plurality of rungs and each of the plurality of leakage teeth may have a center axis extending in the first direction, and the respective center axes of the plurality of rungs may be offset from the respective center axes of the plurality of leakage teeth in a third direction, the third direction being orthogonal to each of the first direction and the second direction. Each winding of the plurality of windings may be partially wound around a respective one of the plurality of rungs such that each winding of the plurality of windings does not overlap with itself when the coupled inductor is viewed cross-sectionally in the third direction.

(A2) In the low-height coupled inductor denoted as (A1), at least one winding of the plurality of windings may extend under a least one of the plurality of leakage teeth in the third direction.

(A3) In the low-height coupled inductor denoted as (A1), two windings of the plurality of windings may extend under one of the plurality of leakage teeth in the third direction.

(A4) In any one of the low-height coupled inductors denoted as (A1) through (A3), each of the plurality of rungs may include a first outer surface, a second outer surface separated from the first outer surface in the second direction, a third outer surface, and a fourth outer surface separated from the third outer surface in the third direction. Each winding of the plurality of windings may be wound around its respective rung of the plurality of rungs such that the winding is not wound around the fourth outer surface of the rung.

(A5) In any one of the low-height coupled inductors denoted as (A1) through (A4), each winding of the plurality of windings may form a first solder tab and a second solder tab that are separated from each other in the second direction by a respective one of the plurality of rungs.

(A6) In the low-height coupled inductor denoted as (A5), (1) the coupled inductor may have a first outer surface, as seen when the coupled inductor is viewed in the third direction, (2) the first solder tab of each winding of the plurality of windings may have a first shape, as seen when the first outer surface of the coupled inductor is viewed in the third direction, (3) the second solder tab of each winding of the plurality of windings may have a second shape, as seen when the first outer surface of the coupled inductor is viewed in the third direction, and (4) the second shape may be a mirror image of the first shape.

(A7) In any one of the low-height coupled inductors denoted as (A1) through (A4), each winding of the plurality of windings may form a first solder tab and a second solder tab extending in the second direction away from the respective rung that the winding is partially wound around.

(A8) Any one of the low-height coupled inductors denoted as (A1) through (A7) may further include a top magnetic layer disposed over the magnetic core and the plurality of windings in the third direction.

(B1) A low-height coupled inductor may include a ladder magnetic core and a plurality of windings. The ladder magnetic core may include (1) a first rail and a second rail separated from each other in a first direction, and (2) a plurality of rungs separated from each other in a second direction, the second direction being orthogonal to the first direction, each rung of the plurality of rungs being disposed between the first rail and the second rail in the first direction. Each winding of the plurality of windings may be partially wound around a respective one of the plurality of rungs, such that the plurality of windings collectively form a zigzag shape as seen when the coupled inductor is viewed cross-sectionally in the first direction.

(B2) In the low-height coupled inductor denoted as (B1), the magnetic core may further include a plurality of leakage teeth, each leakage tooth of the plurality of leakage teeth being disposed between the first rail and the second rail in the first direction.

(B3) In the low-height coupled inductor denoted as (B2), the plurality of windings may be interleaved between the plurality of rungs and the plurality of leakage teeth, as seen when the coupled inductor is viewed cross-sectionally in the first direction.

(B4) In any one of the low-height coupled inductors denoted as (B2) and (B3), at least one of the plurality of leakage teeth may overlap respective portions of two of the plurality of windings, as seen when the coupled inductor is viewed cross-sectionally in a third direction, the third direction being orthogonal to each of the first direction and the second direction.

(B5) In any one of the low-height coupled inductors denoted as (B2) through (B4), the plurality of rungs may be offset from the plurality of leakage teeth in a third direction, the third direction being orthogonal to each of the first direction and the second direction.

(B6) In any one of the low-height coupled inductors denoted as (B1) through (B5), each winding of the plurality of windings may form a first solder tab and a second solder tab that are separated from each other in the second direction by a respective one of the plurality of rungs.

(B7) In any one of the low-height coupled inductors denoted as (B1) through (B5), each winding of the plurality of windings may form a first solder tab and a second solder tab extending in the second direction away from the respective rung that the winding is partially wound around.

(C1) A low-height coupled inductor may include a ladder magnetic core and a plurality of windings. The ladder magnetic core may include (1) a first rail and a second rail separated from each other in a first direction, (2) a plurality of rungs separated from each other in a second direction, the second direction being orthogonal to the first direction, each rung of the plurality of rungs being disposed between the first rail and the second rail in the first direction, and (3) a plurality of leakage teeth, each leakage tooth of the plurality of leakage teeth being disposed between the first rail and the second rail in the first direction. Each winding of the plurality of windings may be partially wound around a respective one of the plurality of rungs such that (1) the plurality of windings form only a single winding layer, as seen when the coupled inductor is viewed cross-sectionally in a third direction, the third direction being orthogonal to each of the first direction and the second direction, and (2) each winding of the plurality of windings is non-overlapping with each other winding of the plurality of windings, as seen when the coupled inductor is viewed cross-sectionally in the first direction.

(C2) In the low-height coupled inductor denoted as (C1), at least one of the plurality of windings may extend under a least one of the plurality of leakage teeth in the third direction.

(C3) In any one of the low-height coupled inductors denoted as (C1) and (C2), each winding of the plurality of windings may form a first solder tab and a second solder tab that are separated from each other in the second direction by a respective one of the plurality of rungs.

(C4) In any one of the low-height coupled inductors denoted as (C1) and (C2), each winding of the plurality of windings may form a first solder tab and a second solder tab extending in the second direction away from the respective rung that the winding is partially wound around.

(C5) In any one of the low-height coupled inductors denoted as (C1) through (C4), the plurality of windings may be interleaved between the plurality of rungs and the plurality of leakage teeth, as seen when the coupled inductor is viewed cross-sectionally in the first direction.

Changes may be made in the above-described coupled inductors, systems, and methods without departing from the scope hereof. For example, although rails, rungs, and coupling teeth are illustrated as being rectangular, the shape of these elements may be varied, such as to have rounded corners. It should thus be noted that the matter contained in the above description and shown in the accompanying drawings should be interpreted as illustrative and not in a limiting sense. The following claims are intended to cover generic and specific features described herein, as well as all statements of the scope of the present devices, methods, and system, which, as a matter of language, might be said to fall therebetween.

What is claimed is:

1. A low-height coupled inductor, comprising:

a ladder magnetic core, including:

a first rail and a second rail separated from each other in a first direction, a plurality of rungs separated from each other in a second direction, the second direction being orthogonal to the first direction, each rung of the plurality of rungs being disposed between the first rail and the second rail in the first direction, and a plurality of leakage teeth, each leakage tooth of the plurality of leakage teeth being disposed between the first rail and the second rail in the first direction, wherein each of the plurality of rungs and each of the plurality of leakage teeth has a center axis extending in the first direction, and the respective center axes of the plurality of rungs are offset from the respective center axes of the plurality of leakage teeth in a third direction, the third direction being orthogonal to each of the first direction and the second direction; and a plurality of windings, each winding of the plurality of windings being partially wound around a respective one of the plurality of rungs such that each winding of the plurality of windings is not wound around all surfaces of the respective rung when the coupled inductor is viewed cross-sectionally in the third direction.

2. The low-height coupled inductor of claim 1, wherein at least one winding of the plurality of windings extends under a least one of the plurality of leakage teeth in the third direction.

3. The low-height coupled inductor of claim 2, wherein two windings of the plurality of windings extend under one of the plurality of leakage teeth in the third direction.

4. The low-height coupled inductor of claim 1, wherein:

each of the plurality of rungs comprises a first outer surface, a second outer surface separated from the first outer surface in the second direction, a third outer surface, and a fourth outer surface separated from the third outer surface in the third direction; and each winding of the plurality of windings is wound around its the respective rung of the plurality of rungs such that the winding is not wound around the fourth outer surface of the rung.

5. The low-height coupled inductor of claim 1, wherein each winding of the plurality of windings forms a first solder tab and a second solder tab that are separated from each other in the second direction by a respective one of the plurality of rungs.

6. The low-height coupled inductor of claim 5, wherein:

the coupled inductor has a first outer surface, as seen when the coupled inductor is viewed in the third direction;

the first solder tab of each winding of the plurality of windings has a first shape, as seen when the first outer surface of the coupled inductor is viewed in the third direction;

the second solder tab of each winding of the plurality of windings has a second shape, as seen when the first outer surface of the coupled inductor is viewed in the third direction; and the second shape is a mirror image of the first shape.

7. The low-height coupled inductor of claim 1 wherein each winding of the plurality of windings forms a first solder tab and a second solder tab extending in the second direction away from the respective rung that the winding is partially wound around.

8. The low-height coupled inductor of claim 1, further comprising a top magnetic layer disposed over the magnetic core and the plurality of windings in the third direction.

9. A low-height coupled inductor, comprising:

a ladder magnetic core, including:

a first rail and a second rail separated from each other in a first direction, a plurality of rungs separated from each other in a second direction, the second direction being orthogonal to the first direction, each rung of the plurality of rungs being disposed between the first rail and the second rail in the first direction; and a plurality of leakage teeth, each leakage tooth of the plurality of leakage teeth being disposed between the first rail and the second rail in the first direction; and a plurality of windings, each winding of the plurality of windings being partially wound around a respective one of the plurality of rungs, such that the plurality of windings are interleaved between the plurality of rungs and the plurality of leakage teeth and collectively form a zigzag shape as seen when the coupled inductor is viewed cross-sectionally in the first direction.

10. The low-height coupled inductor of claim 9, wherein at least one of the plurality of leakage teeth overlaps respective portions of two of the plurality of windings, as seen when the coupled inductor is viewed cross-sectionally in a third direction, the third direction being orthogonal to each of the first direction and the second direction.

11. The low-height coupled inductor of claim 9, wherein the plurality of rungs are offset from the plurality of leakage teeth in a third direction, the third direction being orthogonal to each of the first direction and the second direction.

12. The low-height coupled inductor of claim 9, wherein each winding of the plurality of windings forms a first solder tab and a second solder tab that are separated from each other in the second direction by a respective one of the plurality of rungs.

13. The low-height coupled inductor of claim 9, wherein each winding of the plurality of windings forms a first solder tab and a second solder tab extending in the second direction away from the respective rung that the winding is partially wound around.

14. A low-height coupled inductor, comprising:

a ladder magnetic core, including:

a first rail and a second rail separated from each other in a first direction, a plurality of rungs separated from each other in a second direction, the second direction being orthogonal to the first direction, each rung of the plurality of rungs being disposed between the first rail and the second rail in the first direction, and a plurality of leakage teeth, each leakage tooth of the plurality of leakage teeth being disposed between the first rail and the second rail in the first direction; and a plurality of windings, each winding of the plurality of windings being partially wound around a respective one of the plurality of rungs such that:

the plurality of windings form only a single winding layer, as seen when the coupled inductor is viewed cross-sectionally in a third direction, the third direction being orthogonal to each of the first direction and the second direction, and each winding of the plurality of windings is non-overlapping with each other winding of the plurality of windings, as seen when the coupled inductor is viewed cross-sectionally in the first direction.

15. The low-height coupled inductor of claim 14, wherein at least one of the plurality of windings extends under a least one of the plurality of leakage teeth in the third direction.

16. The low-height coupled inductor of claim 14, wherein each winding of the plurality of windings forms a first solder tab and a second solder tab that are separated from each other in the second direction by a respective one of the plurality of rungs.

17. The low-height coupled inductor of claim 14, wherein each winding of the plurality of windings forms a first solder tab and a second solder tab extending in the second direction away from the respective rung that the winding is partially wound around.

18. The low-height coupled inductor of claim 14, wherein the plurality of windings are interleaved between the plurality of rungs and the plurality of leakage teeth, as seen when the coupled inductor is viewed cross-sectionally in the first direction.

* * * * *